US007431627B2

(12) United States Patent
Oida et al.

(10) Patent No.: US 7,431,627 B2
(45) Date of Patent: Oct. 7, 2008

(54) METHOD OF MANUFACTURING PLASMA DISPLAY PANEL AND METHOD OF MANUFACTURING PLASMA DISPLAY APPARATUS

(75) Inventors: Osamu Oida, Kagoshima Prefecture (JP); Takuo Shinohara, Kagoshima Prefecture (JP)

(73) Assignee: Pioneer Corporation, Tokyo (JP)

( * ) Notice: Subject to any disclaimer, the term of this patent is extended or adjusted under 35 U.S.C. 154(b) by 580 days.

(21) Appl. No.: 11/007,215

(22) Filed: Dec. 9, 2004

(65) Prior Publication Data

US 2005/0130547 A1 Jun. 16, 2005

(30) Foreign Application Priority Data

Dec. 12, 2003 (JP) ..... 2003-415813
Sep. 29, 2004 (JP) ..... 2004-285332

(51) Int. Cl.
*H01J 9/00* (2006.01)
*H01J 17/49* (2006.01)

(52) U.S. Cl. ..... 445/24; 445/25; 427/58; 427/126.2

(58) Field of Classification Search ..... 445/24, 445/25; 313/582–587
See application file for complete search history.

(56) References Cited

U.S. PATENT DOCUMENTS 6,156,433 A * 12/2000 Hatori et al. ..... 430/312
6,620,012 B1 * 9/2003 Johnson et al. ..... 445/3
2002/0050782 A1 * 5/2002 Ito et al. ..... 313/582
2003/0108820 A1 * 6/2003 Baret et al. ..... 430/315

FOREIGN PATENT DOCUMENTS

JP 2001-297691 10/2001
JP 2003-223851 8/2003
KR 2002-0058938 7/2002

OTHER PUBLICATIONS

Korean Office Action dated Aug. 30, 2006, with English Translation.

* cited by examiner

*Primary Examiner*—Mariceli Santiago
(74) *Attorney, Agent, or Firm*—McGinn IP Law Group, PLLC

(57) ABSTRACT

Address electrode patterns are formed on a rear surface glass substrate using a silver paste for forming address electrodes, and these patterns are dried. The average particle size of the silver powder in the silver paste is approximately 10 nm, and the softening point of the glass frit is approximately 420° C. The content ratio of the glass frit in the silver paste is set to 5 wt %. Then, a dielectric layer pattern is formed by using glass paste for forming a white dielectric layer so as to cover the address electrode patterns, and this dielectric layer pattern is dried. The glass frit in the glass paste has a softening point of approximately 540° C. Then, the address electrode patterns and the dielectric layer patterns are baked at a temperature of 540° C. Thus, the resin components in the address electrode patterns and the dielectric layer pattern are burnt away, and the glass frit components are softened so as to be fixed onto the rear surface glass substrate.

6 Claims, 15 Drawing Sheets

METHOD OF MANUFACTURING PLASMA DISPLAY PANEL AND METHOD OF MANUFACTURING PLASMA DISPLAY APPARATUS

BACKGROUND OF THE INVENTION

1. Field of the Invention

The present invention relates to a method of manufacturing a plasma display panel and to a plasma display apparatus, and more particularly to, for example, a method of manufacturing a plasma display panel and a method of manufacturing a plasma display apparatus wherein electrodes and a dielectric layer are formed in the same baking (calcining) step.

2. Description of the Related Art

In general, a plasma display apparatus having a plasma display panel as a main component (hereinafter, also referred to as "PDP") has various advantages compared with a CRT (Cathode Ray Tube) display or liquid crystal display apparatus, or the like, in that it produces no flicker, has a larger display contrast ratio, greater capacity for providing a large screen in a thin unit, faster response, and the like. Therefore, in recent years, plasma display apparatus are used as large-size flat-screen television receivers, displays for information processing devices, and the like.

A plasma display apparatus displays images by irradiating ultraviolet light generated by discharge, onto a fluorescent body, and extracting the visible light generated thereby. Plasma display apparatus can be categorized broadly according to their operating scheme into AC type apparatus wherein the electrodes are covered with a dielectric body and operate indirectly in a state of alternating current discharge, and DC type apparatus wherein the electrodes are exposed to the discharge space and operate in a state of direct current discharge. AC type apparatus, in particular, yield high luminosity and allow large-screen displays to be achieved readily by means of a relatively simple structure, and hence they are used widely. AC type plasma display panels having different electrode structures, namely, surface discharge type panels and opposed electrode type panels, have been proposed.

In general terms, a plasma display panel which forms the main component of an AC type plasma display apparatus is constituted by positioning a front surface substrate made from a transparent material, such as glass, and a rear surface substrate, in an opposing fashion, and forming a discharge gas space for generating plasma between the two substrates.

An AC type plasma display apparatus equipped with a plasma display panel of a three-electrode surface discharge structure can suppress the effects of high-energy ions generated by the surface discharge conducted at the front surface substrate, and therefore can achieve long life. Thus, this type of AC type plasma display apparatus can be applied in the widest range of situations. In the three-electrode surface discharge structure, row type electrodes consisting of scanning electrodes and sustaining electrodes (common electrodes) are disposed in parallel to each other in the horizontal direction on the inner surface of the front surface substrate, which is one of the aforementioned pair of substrates forming discharge cells (hereinafter, called "cells"), and column electrodes consisting of address electrodes (data electrodes) are disposed vertically in a direction orthogonal to the row electrodes on the inner surface of the rear surface substrate which is the other of the pair of substrates.

In a three-electrode surface discharge type AC plasma display apparatus, a write discharge for selecting a discharge cell that is to be displayed (illuminated) is performed between an address electrode on the rear surface substrate and a scanning electrode on the front surface substrate. Then, a sustaining discharge (display discharge) based on a surface discharge in the selected cell is performed between a scanning electrode and a sustaining electrode on the front surface substrate. The scanning electrode and sustaining electrode form an electrode pair. In such a plasma display panel, red, green and blue fluorescent layers are formed on the inner surface of the rear surface substrate, in such a manner that a color plasma display apparatus capable of emitting light of multiple colors is provided.

As shown in FIG. 16 of the accompanying drawings, a plasma display panel 101 forming the principal component of a plasma display apparatus includes a front surface substrate 102 and a rear surface substrate 103 in an opposing fashion, and discharge gas spaces 104 formed between the front surface substrate 102 and the rear surface substrate 103.

The front surface substrate 102 includes a front surface glass substrate 105, scanning electrodes 106, sustaining electrodes 107, transparent dielectric layer 108 and protective layer 109. The front surface glass substrate 105 is made of a transparent material, such as glass. The scanning electrodes 106 and sustaining electrodes 107 include transparent electrodes 106*a* and 107*a* made of tin oxide, ITO (Indium Tin Oxide), or the like, formed in a parallel fashion in the row direction on the inner surface of the front surface glass substrate 105, and bus electrodes 106*b* and 107*b* made of Al, Cu, Ag, or the like, placed on the transparent electrodes 106*a* and 107*a* for reducing the resistance value. The transparent dielectric layer 108 is made of a low-melting-point glass, such as PbO (lead oxide), and covers the scanning electrodes 106 and the sustaining electrodes 107. The protective layer 109 is made of MgO (magnesium oxide), or the like, having a high secondary electron emission coefficient and excellent anti-sputtering properties, for the purpose of protecting the transparent dielectric layer 108 from the discharge generated during operation.

The rear surface substrate 105 includes a rear surface glass substrate 110, address electrodes 111, white dielectric layer 112, partitions 113 and fluorescent layers 114. The rear surface glass substrate 110 is made of a transparent material, such as glass. The address electrodes 111 are made of Al, Cu, Ag, or the like, and formed in parallel in the column direction on the inner surface of the rear surface glass substrate 110. The white dielectric layer 112 covers the address electrodes 111. The partitions 113 are made of low-melting-point glass, or the like. The partitions 113 extend in the vertical direction in order to maintain the discharge gas space 104 which is filled with a discharge gas, such as He (Helium), Ne (Neon), Xe (Xenon), in either independent or combined fashion, and to divide the space into individual discharge cells. The fluorescent layers 114 include red, green and blue fluorescent layers, and are disposed on the base portion and side portions of the discharge cell formed by the partitions 113, for converting the ultraviolet light generated by the electrical discharge of the discharge gas into visible light.

For the red fluorescent material, (Y, Gd) BO: Eu, or (Y, GD) $BO_3$: Eu is used, for the green fluorescent material, $Zn_2SiO_4$: Mn is used, and for the blue fluorescent material, $BaMgAl_{10}O_{17}$: Eu is used.

A method of manufacturing a three-electrode surface discharge type AC plasma display panel 101 of this kind will now be described with reference to FIG. 16 and FIG. 17 of the accompanying drawings. FIG. 17 depicts the flowchart of the manufacturing process.

Firstly, as shown in FIG. 16, transparent electrodes 106*a* and 107*a* are formed in parallel in the horizontal direction H on the inner surface of the front surface glass substrate 105, thereby forming the front surface substrate 102 (step SA11 (FIG. 17)).

Then, bus electrodes 106*b* and 107*b* for reducing the resistance are formed in the horizontal direction on top of the transparent elements 106*a* and 107*a* (on the lower surface thereof in FIG. 16) (step SA12). More specifically, if silver is chosen as the electrode material, the bus electrodes 106*b* and 107*b* are formed by patterning a silver paste consisting of powdered silver, glass frit and an organic binder, by means of screen printing or the like, burning away the organic binder and softening the glass frit by baking (calcining) the silver paste, and fixing a bus electrode pattern to the front surface glass substrate 105.

In this way, scanning electrodes 106 and sustaining electrodes 107 are formed by means of the transparent electrodes 106*a* and 107*a*, and the bus electrodes 106*b* and 107*b*.

Next, a transparent dielectric layer 108 covering the scanning electrodes 106 and the sustaining electrodes 107 is formed (step SA13). More specifically, the transparent dielectric layer 108 is formed by forming a glass paste consisting of glass frit and an organic binder, by means of screen printing or a table coater, or the like, then burning away the organic binder and softening the glass frit by baking the glass paste, and fixing a transparent dielectric layer pattern to the front surface glass substrate 105.

Next, a protective film 109 for protecting the transparent dielectric layer 108 from discharges is formed (step SA14). Thus, the front surface substrate 102 is completed.

As shown in FIG. 16, in order to manufacture the rear surface substrate 103, address electrodes 111 are formed in parallel in the vertical direction on the upper surface of the rear surface glass substrate 110 (step SB11 (FIG. 17)). More specifically, if silver is selected as the electrode material, address electrodes 111 are formed by patterning a silver paste consisting of powdered silver, glass frit and an organic binder, by means of screen printing, or the like, then burning away the organic binder and softening the glass frit by baking the silver paste, and fixing an address electrode pattern to the rear surface glass substrate 110.

Next, a white dielectric layer 112 covering the address electrodes 111 is formed (step SB12). More specifically, the white dielectric layer 112 is provided by forming a glass paste consisting of glass frit and an organic binder by means of screen printing, a table coater, or the like, then, burning away the organic binder and softening the glass frit by baking the glass paste, and fixing a white dielectric layer pattern to the rear surface glass substrate 110.

In order to demarcate the discharge cells, partitions 113 are formed on the white dielectric layer 112 in a stripe fashion (step SB13). More specifically, partitions 113 are formed by coating a glass paste consisting of glass frit and an organic binder uniformly on the white dielectric layer 112 by reverse coating, slit coating, or the like, then patterning a resist thereon, cutting openings in the resist by sandblasting, or the like, and baking the glass paste, thereby burning away the organic binder and softening the glass frit, and causing a partition pattern to become fixed to the white dielectric layer 112.

Next, fluorescent layers 114 are formed between the respective partitions 113 (step SB14).

Then, sealing frit is coated about the outer perimeter portion of the rear surface glass substrate 110 and this frit is baked, thereby completing the rear surface substrate 103 (step SB15).

Then, the front surface substrate 102 and the rear surface substrate 103 are placed in an opposed state, separated from each other by a gap of approximately 100 μm therebetween. In this state, the substrates 102 and 103 are bonded together in such a manner that the extending direction of the electrode pairs (row direction) is orthogonal to the extending direction of the address electrodes 111 (column direction), and in such a manner that a discharge gas space 104 is formed between the substrates 102 and 103 (step SC16). The perimeter portion of the substrates 102 and 103 is then sealed hermetically by means of a sealing material made of frit glass, for example (step SC17).

After the frit glass is coated on the perimeter section of the rear surface substrate 103, the front surface substrate 102 and the rear surface substrate 103 are baked in the bonded state, so as to melt the frit glass and join the front surface substrate 102 to the rear surface substrate 103 in the form of a panel. The discharge cells are demarcated by the partitions 113.

Next, the front surface substrate 102 and the rear surface substrate 103 forming a panel shape are introduced into a heating oven. An air pipe is connected to the discharge space formed between the front surface substrate 102 and the rear surface substrate 103, and the substrates are heated in vacuum conditions while expelling the air from the discharge space. Then, a discharge gas consisting of a mixed rare gas containing xenon, for example, is introduced into the discharge gas space 104 at a prescribed pressure, thereby filling the discharge gas space. The air pipe is then sealed by overheating thus closing off the open end of the pipe (step SC18). In this way, discharge gas is filled into the discharge gas space 104.

An electrical discharge is then generated inside the discharge cells and the discharge is continued for a prescribed period of time so that the discharge becomes stable (step SC19).

In this way, discharge gas is filled into the discharge gas space 104 and a plasma display panel 101 is completed.

As described above, it is necessary to perform a large number of baking steps in order to manufacture a plasma display panel 10. By means of these baking processes, the organic binder contained inside the paste layers is burnt away and no organic components are left remaining inside the panel, while at the same time, the electrode material and other materials become fixed to the glass substrates due to the softening of the glass components therein.

Next, a method of performing baking will be described in detail with reference to FIG. 18 of the accompanying drawings.

As shown in this diagram, the temperature profile of the baking process includes a temperature rise portion $L_1$, a binder removing portion $L_2$, another temperature rise portion $L_3$, a temperature-keeping portion $L_4$, and a temperature fall portion $L_5$.

In the first temperature rise portion $L_1$, from time $t_0$ until time $t_1$, the temperature is increased to a temperature $T_a$ approximately 10-20° C. higher than the burning temperature of the organic binder. The rate of temperature rise is set to approximately 10-20° C. per minute.

In the binder removal portion $L_2$, the temperature $T_a$ (i.e., baking temperature) is maintained for a prescribed period of time (binder removal time) from time $t_1$ to time $t_2$, thereby causing the organic binder in the paste to burn away completely. This prescribed time period ($t_2-t_1$) is determined by taking account of the type of organic binder contained in the paste, and the respective thickness of the electrodes, transparent dielectric layer and white dielectric layer, amongst other factors. Generally, this time period is set to around 5-20 minutes.

In the second temperature rise portion $L_3$, from time $t_2$ until time $t_3$, the temperature is raised to a temperature $T_b$ equal to or exceeding the softening point of the glass frit.

The softening point is taken to be the temperature at which a sample of the glass frit transforms from a sintering shrinkage phase to a soft fluid phase due to temperature rise, in a Differential Thermal Analysis (DTA). In other words, the above mentioned softening point is as the DTA softening point in this specification.

In the temperature-keeping portion $L_4$, the temperature $T_b$ is maintained as a baking temperature for a prescribed time period (hold time) from time $t_3$ until time $t_4$. This hold time ($t_4$–$t_3$) is set to the time period required until the glass frit softens completely and until all air bubbles are removed entirely from the electrodes and dielectric layers. In general, this time period is approximately 10-40 minutes.

In the temperature fall portion $L_5$, the temperature declines at a temperature decline rate generally set to approximately 3-7° C. per minute, from time $t_4$ until time $t_5$.

Normally, if a glass sheet is cooled rapidly, deformation or distortion will be left in the glass sheet due to uneven cooling, and hence the glass may fracture or suffer from uneven shrinkage upon baking. This fracturing or uneven shrinkage of the glass may be several hundred ppm in size, and in a 42-inch plasma display panel for example, the uneven shrinkage will be approximately several 100 μm. Considering that the cells emitting red, green and blue light in a 42-inch VGA class display apparatus are approximately 350 μm in size, this extent of deformation of the glass substrate caused by sudden cooling is a critical problem in plasma display apparatus. Therefore, in general, the temperature is lowered gradually in order to avoid residual distortion in the glass.

Consequently, in the case of a baking temperature of 600° C., for example, the time period required for one baking process is approximately 2 hours at shortest, and approximately 5 hours at longest. Under these conditions, in order to manufacture with a tact time of two minutes, the baking oven is required to have a length of 60-150 meters per baking operation, and it must have a width capable of accommodating a substrate of approximately one meter square. If a baking oven of this kind is required for each of the baking processes illustrated in FIG. 17, then the installation surface area and power consumption required for the baking oven will be huge, the building accommodating the plasma display apparatus mass-production plant will inevitably be very large, energy consumption will be huge, and the manufacturing costs will also be very high.

In order to reduce the time required in the baking processes, technology has been proposed wherein an electrode pattern is formed on a substrate by using a conductive ink containing a conductive powder and an organic binder that can be removed by baking, a dielectric layer pattern is then formed so as to cover the electrode pattern by using a dielectric forming paste containing glass frit and an organic binder that can be removed by baking, and an electrode layer and a dielectric layer are then formed by baking the electrode pattern and the dielectric layer pattern simultaneously (see, for example, Japanese Patent Application Laid-open (Kokai) No. 2001-297691).

In this technique, a partition pattern is formed on the dielectric layer pattern by using a partition forming paste containing glass frit and an organic binder, and the electrode layer, the dielectric layer and the partitions are formed by simultaneously baking the electrode pattern, the dielectric layer pattern and the partition pattern. An under-layer pattern is formed on the substrate by using an under-layer forming paste containing glass frit and an organic binder, an electrode pattern is formed on top of the under-layer pattern, and a dielectric layer pattern is formed on top of the electrode pattern. Then, an under-layer, an electrode layer and a dielectric layer are formed by simultaneously baking the under-layer pattern, the electrode pattern and the dielectric layer pattern.

Technology has also been proposed wherein a metal paste layer containing powdered metal and glass frit is formed on a substrate, and a glass paste layer containing glass frit is formed on top of the metal paste layer, then an electrode layer containing crystallized glass and a dielectric layer consisting of a low-melting-point glass layer are formed by simultaneously baking the metal baste and the glass paste (see Japanese Patent Application Laid-open No. 2003-223851, for example).

Here, simultaneous baking is performed so that the peak of crystallization temperature of the crystallized glass has a value lower than the softening point of the low-melting-point glass (the abovementioned DTA softening point).

In the technology disclosed in Japanese Patent Application Laid-open No. 2001-297691, in particular, the powdered silver, or the like, forming the conductive powder is dispersed into the dielectric medium during the simultaneous baking process, thus causing the dielectric medium to assume a yellow color. If this simultaneously baked substrate is used as a front surface substrate, then the display quality of the resulting plasma display apparatus is degraded markedly.

More specifically, if two or more paste layers are baked simultaneously, then the components in the different layers may move and become mixed together, and air bubbles may occur within the layers. In particular, if silver is used as the conductive material, then the silver will disperse into the dielectric medium regardless of the presence or absence of glass frit in the conductive ink, and hence the transparent dielectric layer will turn yellow.

In the technology disclosed in Japanese Patent Application Laid-open No. 2001-297691 and Japanese Patent Application Laid-open No. 2003-223851, the electrode layer becomes conductive after baking has been performed. Therefore, even if faults in the electrodes are identified by performing an electrical inspection, or the like, after baking, it is not possible to repair these faults since the respective layers are baked simultaneously and most of the electrode layer is already covered with the dielectric layer. Thus, defective products may result.

More specifically, an electrode layer formed by a thick film technique, such as screen printing, offset printing, photosensitive paste coating, or the like, using silver, or the like, as a conductive material, only becomes conductive when the organic binder is removed by baking. If simultaneous baking is not adopted, then the electrodes are usually inspected after baking by means of image inspection using image recognition, and electrical inspection wherein current is actually passed through the electrodes and any connection failures or shorting to adjacent electrodes are identified. Any faults can be repaired if abnormalities are discovered as a result of these inspection processes. However, if simultaneous baking is adopted, it is not possible to repair the electrode layer, since a dielectric layer will already be formed thereon.

In the technology disclosed in Japanese Patent Application Laid-open No. 2001-297691, in particular, if the simultaneous baking process is conducted, gas is generated during baking upon burning away of the organic binder contained in the electrode pattern and this gas escapes into the dielectric layer covering the electrode layer. Since the gas cannot pass through the dielectric layer, it forms bubbles which become trapped inside the dielectric layer. This can give rise to voltage resistance faults in the dielectric layer when the display panel is used.

In the technology disclosed in Japanese Patent Application Laid-open No. 2003-223851, in particular, although the problems of the dispersion of silver, or the like, into the dielectric layer and the generation of gas bubbles are resolved, the type of glass frit that can be used in the metal paste is restricted to crystalline glass, for example.

SUMMARY OF THE INVENTION

It is a first object of the present invention to provide a method of manufacturing a plasma display panel and a method of manufacturing a plasma display apparatus whereby the time required for baking (calcining) processes can be reduced by means of simultaneous baking, while being able to prevent discoloration of the dielectric layer and maintain good display quality.

It is a second object of the present invention to provide a method of manufacturing a plasma display panel and a method of manufacturing a plasma display apparatus whereby the time required for baking processes can be reduced by means of simultaneous baking, while at the same time, electrical inspection of electrode layers, for example, can be carried out, and any faults, such as disconnections in the electrode layer, discovered by the inspection process can be repaired.

It is a third object of the present invention to provide a method of manufacturing a plasma display panel and a method of manufacturing a plasma display apparatus whereby the time required for baking processes can be reduced by means of simultaneous baking, while at the same time, any gas generated by burning away of an organic binder contained in an electrode pattern during the baking process is prevented from becoming sealed (trapped) inside a dielectric layer pattern covering the electrode pattern and remaining as gas bubbles within same, thereby suppressing the possibility of voltage resistance faults in the dielectric layer when the display panel (or display apparatus) displays an image.

It is a fourth object of the present invention to provide a method of manufacturing a plasma display panel and a method of manufacturing a plasma display apparatus, whereby the time required for baking processes can be reduced by means of simultaneous baking, while at the same time, discoloration of the dielectric layer can be prevented, irrespectively of the type of glass frit contained in a metal paste, for example, and hence good display quality can be maintained.

According to one aspect of the present invention, there is provided an improved method of manufacturing a plasma display panel. This manufacturing method includes forming a metal paste layer, in which metal powder and a first glass frit are combined at a prescribed ratio, onto at least one substrate of a pair of opposing substrates. The manufacturing method also includes forming a glass paste layer, which contains a second glass frit, onto the metal paste layer, and forming an electrode layer and a dielectric layer by simultaneously baking the metal paste and the glass paste. The prescribed ratio is set in such a manner that a content ratio of the first glass frit in the electrode layer becomes between 1 wt % and 12 wt %. The first glass frit has a softening point equal to or lower than a softening point of the second glass frit.

The average particle size of the metal powder may be between 1 nm and 50 nm. The metal powder may be silver powder or gold powder.

The softening point is basically the softening point as defined by the viscosity, and it also covers a broad concept including cases where the softening point is taken to be the temperature at which the glass frit changes from a sintering shrinkage phase to a soft fluid phase as the temperature rises in a differential thermal analysis.

According to this method of manufacturing a plasma display panel, it is possible to reduce the time required for baking processes by means of simultaneous baking, and hence manufacturing costs can be reduced. Since the glass frit in the metal paste has a softening point equal to or lower than that of the glass frit in the glass paste, and the content ratio of the glass frit in the metal paste is set to a suitable value, it is possible to prevent the metal from dispersing into the dielectric layer during baking. Hence, discoloration of the dielectric layer is avoided and good display quality can be maintained.

By baking the metal paste and the glass paste at a suitable baking temperature, it is possible further to prevent the metal from dispersing into the dielectric layer during baking, and hence discoloration of the dielectric layer is avoided even more reliably, and good display quality can be maintained.

According to another aspect of the present invention, there is provided another method of manufacturing a plasma display panel. This manufacturing method includes forming a conductive paste layer containing metal oxide and a first glass frit, onto at least one substrate of a pair of opposite substrates. The manufacturing method also includes forming a metal paste layer, in which metal powder and a second glass frit are combined at a prescribed ratio, onto the conductive paste layer. The manufacturing method also includes forming a glass paste layer, which contains a third glass frit, onto the metal paste layer. The manufacturing method also includes forming a first electrode layer, a second electrode layer and a dielectric layer by simultaneously baking the conductive paste, the metal paste and the glass paste. The first glass frit has a softening point equal to or lower than the softening point of the third glass frit. The prescribed ratio is set in such a manner that a content ratio of the second glass frit in the second electrode layer becomes between 1 wt % and 12 wt %. The second glass frit has a softening point equal to or lower than the softening point of the third glass frit.

The average particle size of the metal powder may be between 1 nm and 50 nm. The metal powder may be silver powder or gold powder.

It is possible to reduce the time required for baking processes by means of simultaneous baking, and hence manufacturing costs can be reduced. Since the content ratio of the glass frit in the metal paste is set to a suitable value, the metal paste layer is conductive in a dried condition. Therefore, electrical inspection of the electrode layer, for example, can be performed before forming the glass paste layer. If any faults, such as disconnections, or the like, are discovered in the electrode layer by means of this inspection, then those faults can be repaired. Consequently, it is possible to avoid decline in the production yield.

By setting the average particle size of the metal powder used in the metal paste to a suitable value, as well as the content ratio of the glass frit in the metal paste, the metal paste layer shows even greater conductivity upon drying. Therefore, the inspection can be carried out more reliably.

According to still another aspect of the present invention, there is provided another method of manufacturing a plasma display panel. This manufacturing method includes forming a metal paste layer, in which metal powder and a first glass frit are combined at a prescribed ratio, onto one substrate of a pair of opposite substrates. The manufacturing method also includes forming a glass paste layer for forming partitions onto the substrate on which the metal paste layer is formed. This glass paste layer contains metal oxide and a second glass frit. The manufacturing method also includes forming an electrode layer and the partitions by simultaneously baking the metal paste and the glass paste. The prescribed ratio is set in such a manner that the content ratio of the first glass frit in the electrode layer becomes between 1 wt % and 12 wt %. The first glass frit has a softening point equal to or lower than the softening point of the second glass frit.

The average particle size of the metal powder may be between 1 nm and 50 nm. The metal powder may be silver powder or gold powder.

It is possible to reduce the time required for baking processes by means of simultaneous baking, and hence manufacturing costs can be reduced. Furthermore, since the glass frit in the metal paste has a softening point equal to or lower than that of the glass frit in the glass paste, if gas is generated by the burning away of the organic binder contained in the electrode pattern in particular, during the baking process, then that gas is prevented from becoming sealed inside the dielectric layer pattern covering the electrode pattern and remaining trapped inside that layer in the form of bubbles. Therefore, the possibility of voltage resistance faults in the dielectric layer is suppressed when the display panel (or display apparatus) is used to display an image.

According to yet another aspect of the present invention, there is provided another method of manufacturing a plasma display panel. This manufacturing method includes forming a conductive paste layer containing metal oxide and a first glass frit, onto at least one substrate of a pair of opposed substrates. The manufacturing method also includes forming a metal paste layer containing metal powder onto the conductive paste layer, and forming a glass paste layer containing a second glass frit onto the metal paste layer. The manufacturing method also includes forming a first electrode layer, a second electrode layer and a dielectric layer by simultaneously baking the conductive paste, the metal paste and the glass paste. The first glass frit has a softening point equal to or lower than the softening point of the second glass frit.

The average particle size of the metal powder may be between 0.001 μm and 5 μm. The metal powder may be silver powder or gold powder.

It is possible to reduce the time required for baking processes by means of simultaneous baking, and hence manufacturing costs can be reduced. By setting the content ratio of the glass frit in the metal paste to a suitable value, discoloration of the dielectric layer can be prevented, irrespectively of the type of glass frit contained in the metal paste, for example. Accordingly, good display quality can be maintained.

In any of the aforementioned methods of manufacturing a plasma display panel, inspection of the electrical characteristics of the metal paste layer and/or the conductive paste layer may be carried out before the glass paste layer for forming the dielectric layer or the partitions is formed.

In any of the aforementioned methods of manufacturing a plasma display panel, the baking temperature for forming the electrode layer(s), and the dielectric layer or the partitions may be set to a value between the softening point, as defined on the basis of the viscosity of the glass frit used in order to form the dielectric layer or the partitions, and a temperature 30° C. above the softening point.

In any of the aforementioned methods of manufacturing a plasma display panel, taking the softening point of the glass frit for forming the dielectric layer or the partitions to be the temperature at which a sample of the glass frit changes from a sintering shrinkage phase to a soft fluid phase with increase in temperature in a differential thermal analysis, the baking temperature for forming the electrode layer(s), and the dielectric layer or the partitions may be set to a value between a temperature 20° C. below the softening point and a temperature 10° C. above the softening point.

According to another aspect of the present invention, there is provided an improved method of manufacturing a plasma display apparatus. This manufacturing method includes preparing a plasma display panel, and assembling the plasma display panel together with a circuit for driving the plasma display panel, as one module. The manufacturing method also includes electrically connecting, to the module, an interface for converting the format of an image signal and sending the signal to the module. The plasma display panel is prepared in accordance with any one of the above described methods of manufacturing the plasma display panel.

By forming the plasma display apparatus in a modular fashion, it is possible to carry out repairs simply and rapidly by replacing individual modules, if the need to replace a component arises.

The first object is achieved because it is possible to reduce the time required for baking processes by means of simultaneous baking, and hence manufacturing costs can be reduced. Also, since the glass frit in the metal paste has a softening point equal to or lower than that of the glass frit in the glass paste, and the content ratio of the glass frit in the metal paste is set to a suitable value, it is possible to prevent the metal from dispersing into the dielectric layer during baking, and hence discoloration of the dielectric layer is avoided and good display quality can be maintained.

The second object is achieved because it is possible to reduce the time required for baking processes by means of simultaneous baking, and hence manufacturing costs can be reduced. Also, since the content ratio of the glass frit in the metal paste is set to a suitable value, the metal paste layer becomes conductive upon drying and therefore electrical inspection of the electrode layer, for example, can be performed before forming the glass paste layer. If any faults, such as disconnections, or the like, are discovered in the electrode layer by means of this inspection, then those faults can be repaired.

The third object is achieved because it is possible to reduce the time required for baking processes by means of simultaneous baking, and hence manufacturing costs can be reduced. Also, since the glass frit in the metal paste has a softening point equal to or lower than that of the glass frit in the glass paste, gas which may be generated by the burning away of the organic binder contained in the electrode pattern in particular during the baking process, is prevented from becoming sealed inside the dielectric layer pattern covering the electrode pattern and remaining trapped inside that layer in the form of bubbles. Therefore, the possibility of voltage resistance faults in the dielectric layer when the display panel (or display apparatus) is used to display an image is reduced.

The fourth object is achieved because it is possible to reduce the time required for baking processes by means of simultaneous baking and also possible to prevent discoloration of the dielectric layer, irrespectively of the type of glass frit contained in the metal paste, by setting the content ratio the glass frit in the metal paste to a suitable value such that good display quality can be maintained.

DETAILED DESCRIPTION OF THE INVENTION

Below, embodiments of the present invention are described with reference to the drawings.

First Embodiment

Figure 1A:
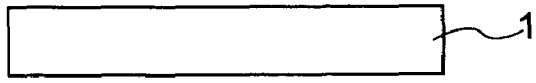
FIG. 1A to FIG. 1C are a series of process diagrams for describing a method of manufacturing a plasma display panel according to a first embodiment of the present invention.
Figure 1B:
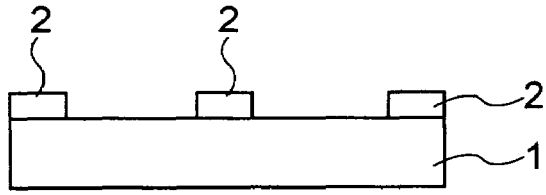
Figure 1C:
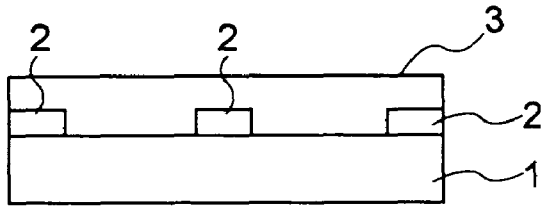
Figure 2:
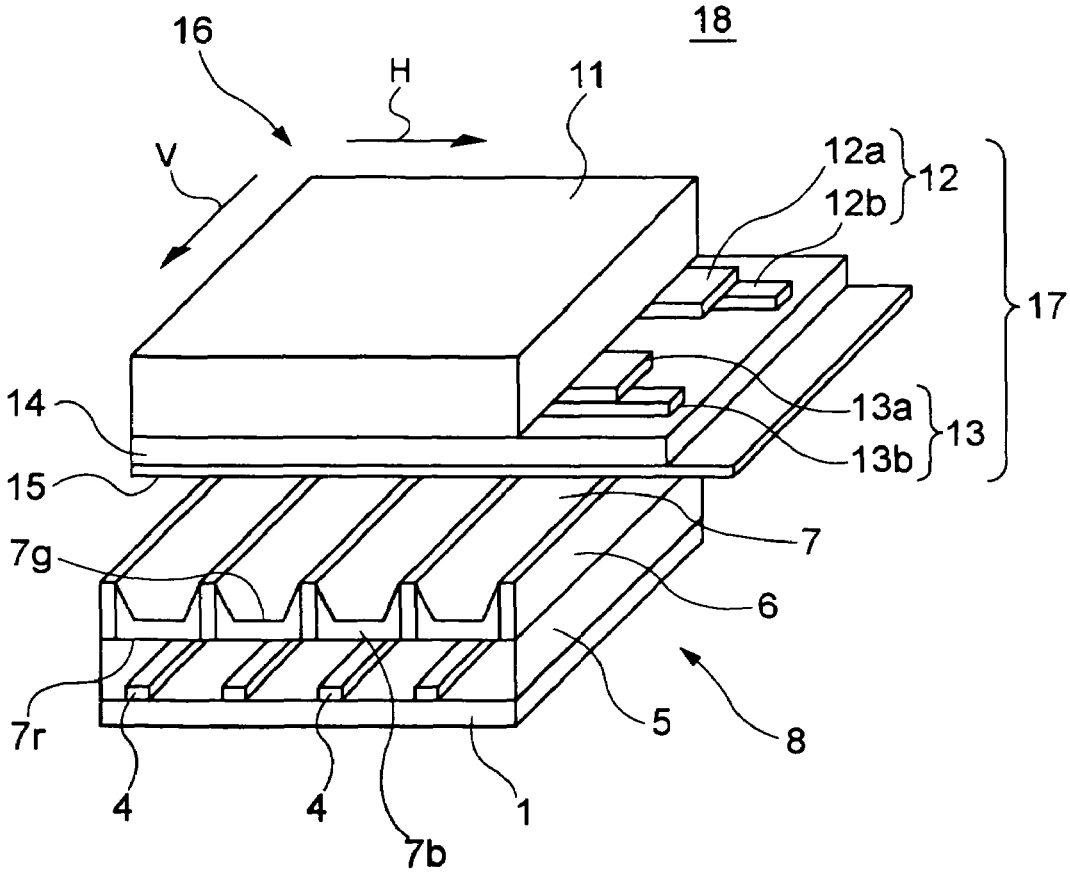
FIG. 2 is a perspective view showing part of an inner structure of this plasma display panel.

A first embodiment is described with reference to FIG. 1A to FIG. 5. FIG. 1A to FIG. 1C are a series of process diagrams for describing a method of manufacturing a plasma display panel 18 according to a first embodiment of the present invention. FIG. 2 is a perspective view, schematically showing the inner structure of the plasma display panel 18.

In the method of manufacturing the plasma display panel 18 according to this embodiment, suitable values are set for the manufacturing conditions, such as the content ratio of the glass frit in the silver paste, the relationship between the softening points of the glass frits in the silver paste and the glass paste, and the average particle size of the silver powder. Then, an address electrode pattern and a dielectric layer pattern are formed and both patterns are baked (calcined) simultaneously, thereby forming a rear surface substrate. A front surface substrate is manufactured by means of a conventional method that does not use simultaneous baking.

Figure 3:
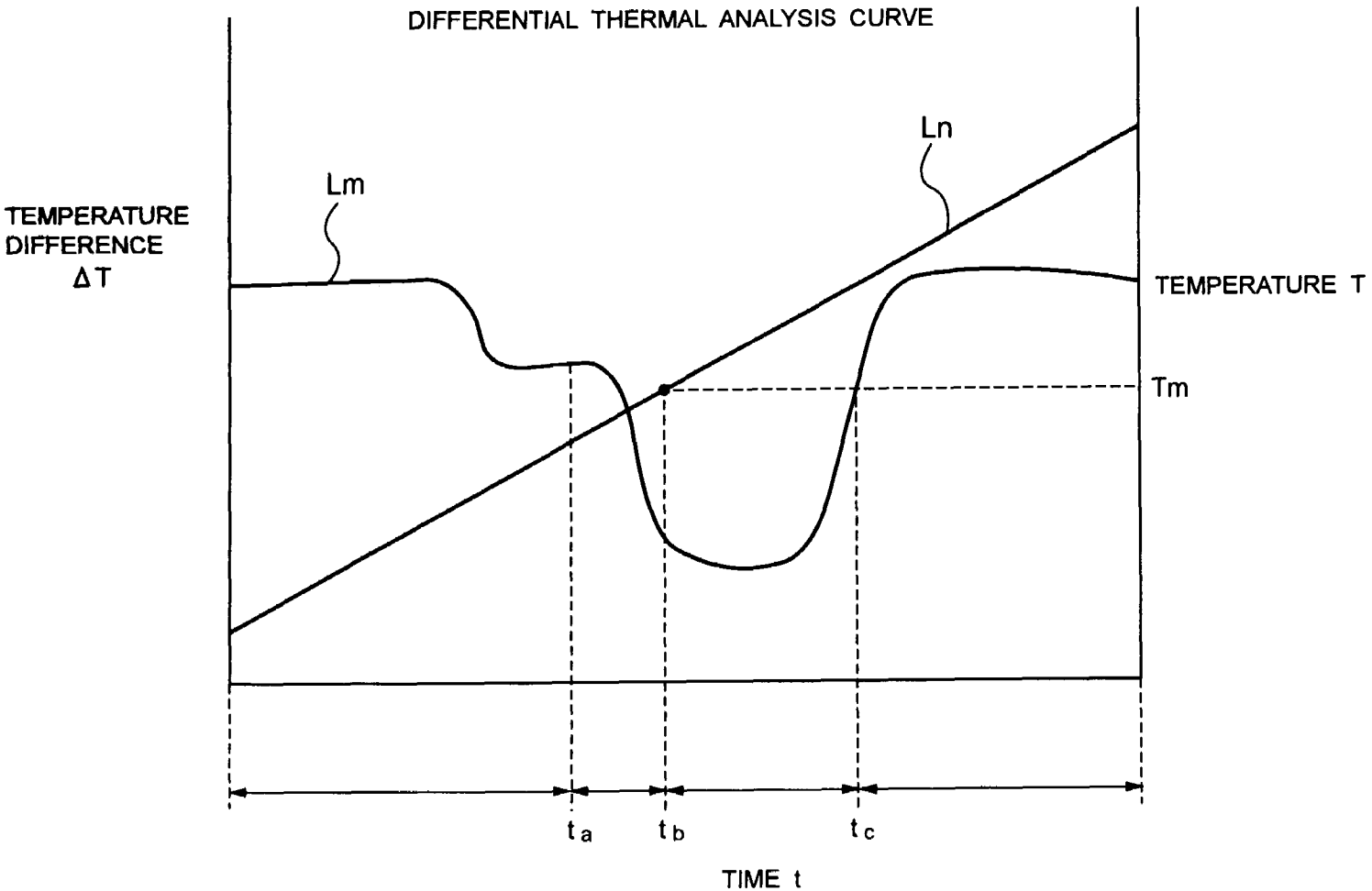
FIG. 3 is a diagram showing differential thermal analysis curve obtained using sample glass frit, and a temperature curve during temperature rise.

Referring to FIG. 3, a differential thermal analysis curve Lm is obtained by recording (plotting) a temperature difference ΔT between a sample of glass frit and a reference material (such as alumina powder), with respect to temperature (or time t). The temperature Tm on the temperature curve Ln at which the sample changes from a sintering shrinkage phase to a soft fluid phase upon heating is taken as the softening point (DTA (Differential Thermal Analysis) softening point) and this softening point is used as a reference for setting manufacturing conditions such as the materials used, the baking temperature, and the like. In the diagram, a downward movement of the differential thermal analysis curve Lm indicates an endothermic reaction.

Figure 4A:
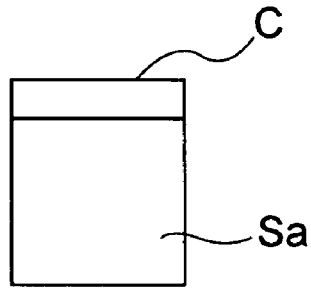
FIG. 4A to FIG. 4E are a series of diagrams for describing the change in the state of the glass frit during differential thermal analysis.
Figure 4B:
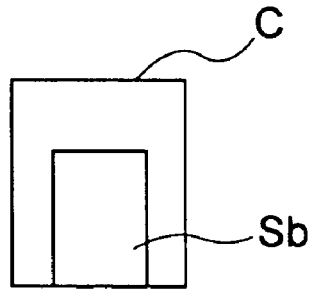
Figure 4C:
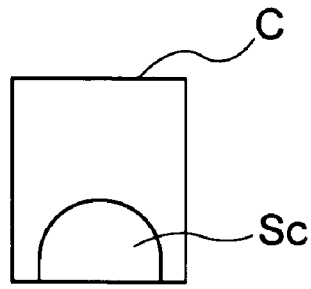
Figure 4D:
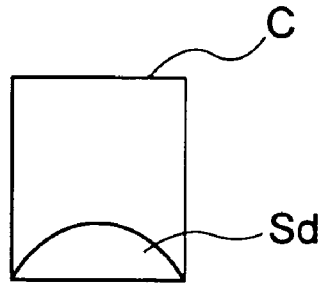
Figure 4E:
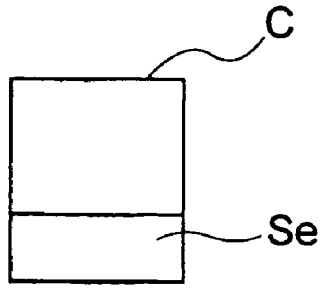

A sample $S_a$ (of glass frit) accommodated in a powdered state inside a capsule C as shown in FIG. 4A is sintered ($t_a<t<t_b$) as the temperature rises, and forms a sintered sample $S_b$ as shown in FIG. 4B. As the temperature rises further, the sample starts to soften and this softening progresses as shown in FIG. 4C and FIG. 4D, forming the soft fluid sample bodies $S_c$ and $S_d$. As the temperature rises yet further, the fluid movement is completed ($t>t_c$), as illustrated in FIG. 4E, and a fluid sample $S_e$ is obtained. The temperature at which the heat absorption on the differential thermal analysis curve Lm changes from a tendency to increase to a tendency to decrease is detected as the softening point Tm.

Referring back to FIG. 1A to 1C, the plasma display panel manufacturing process will be described. Firstly, as shown in FIG. 1A, a rear surface glass substrate 1 is prepared. Glass having a high strain point may be used as the rear surface glass substrate 1, for example. It should be noted that the type of glass used is not limited to the glass having a high strain point.

Then, address electrode patterns 2 are formed using a silver paste for forming address electrodes in a direction parallel to the vertical direction V, on the upper surface of the rear surface glass substrate 1, as shown in FIG. 1B (see FIG. 2 also).

For the silver paste, it is possible to use a paste made of powdered silver, glass frit, and an organic binder.

Silver powder is used as the metal powder, from the viewpoint of simplifying the process, but it is also possible to use other metal powders (e.g., gold powder) which are practical materials for achieving simple processing.

A silver powder having an average particle size between 1 nm and 50 nm is used. An average particle size of 1 nm is the smallest particle size that can be achieved for silver powder using current technology. It is known that silver powder collects about the glass frit and shows conductive properties if the average particle size of the silver powder is 1/100 or less of the particle size of the glass frit. Therefore, assuming that the maximum particle size of generally used glass frit is 5 μm, it is appropriate to set the upper limit of the average particle size of the silver powder to 50 nm.

In this embodiment, silver powder having an average particle size of approximately 10 nm is employed. This size of silver power is known as "nano-particles" due to the particle size.

Figure 5:
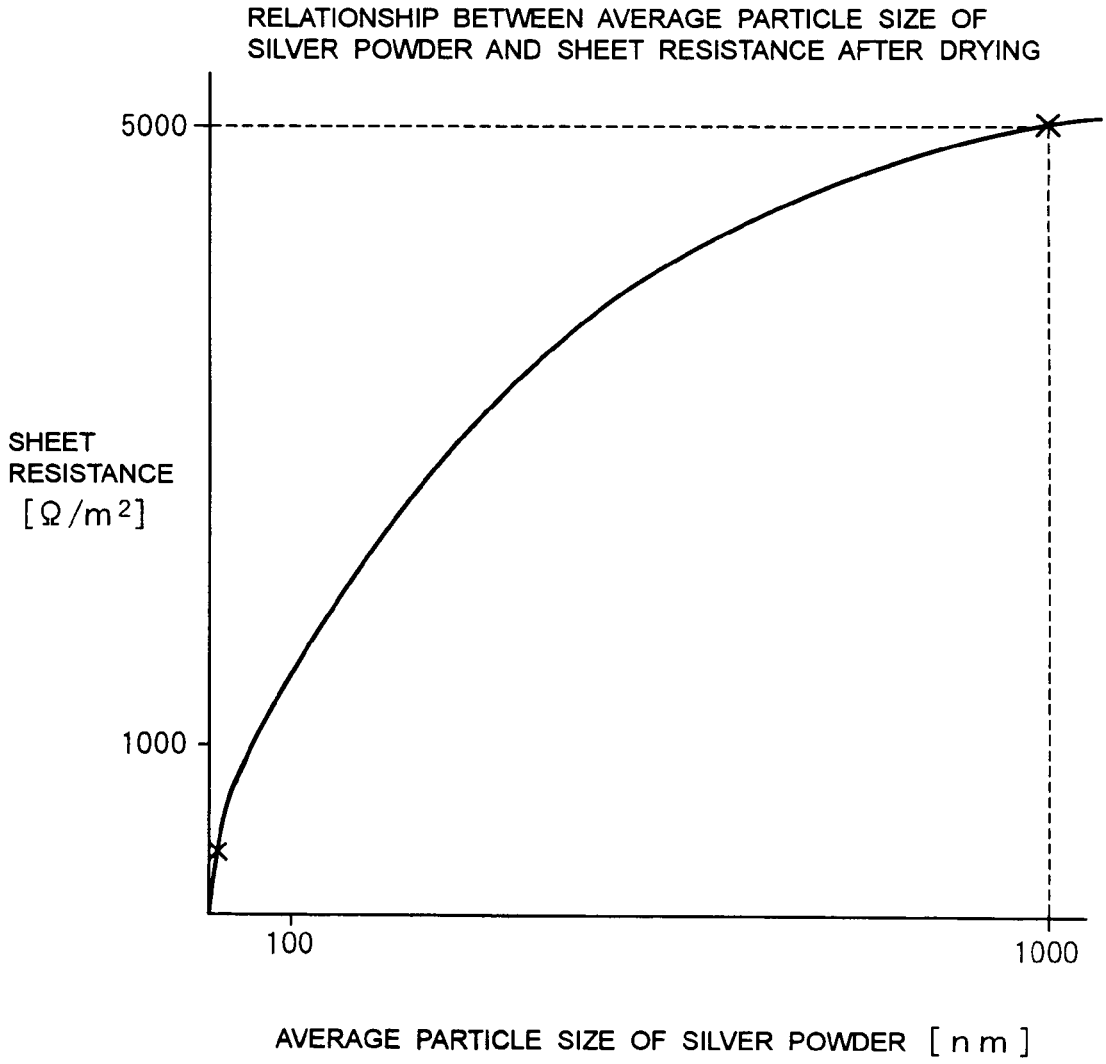
FIG. 5 is a diagram showing the relationship between the average particle size of silver powder and the sheet resistance value after drying.

The inventors obtained the results shown in Table 1 and FIG. 5 when they measured the sheet resistance value after drying with respect to the different average particle sizes of the silver powder. In this experiment, the silver paste was dried at 120° C. for 10 minutes and the film thickness after drying was about 8 μm (and 5 μm after baking).

TABLE 1

| Relationship between average particle size of silver powder and sheet resistance value | |
|---|---|
| Average particle size of silver powder (nm) | Sheet resistance value after drying ($\Omega/m^2$) |
| 1 | 0.1 |
| 2 | 0.1 |
| 5 | 300 |
| 1000 | 5000 |

As shown in Table 1 and FIG. 5, if the average particle size of the silver powder is 1-2 nm, then the sheet resistance is 0.1 $\Omega/m^2$, if the average particle size is 5 nm, then the sheet resistance is 300 $\Omega/m^2$, and if the average particle size is 1 μm, then the sheet resistance is 5000 $\Omega/m^2$. If the average particle size is 50 nm, then the sheet resistance is not greater than 1000 $\Omega/m^2$, and sufficient conductivity is obtained.

Glass frit having a softening point equal to or lower than that of the glass frit in the glass paste is used. In this embodiment, glass frit made from $Bi_2O_3$ or similar material and having a softening point of approximately 420° C. is used.

An organic binder having a cellulose or acrylic material as the resin component and BCA (butyl carbitol acetate) or α-terpinenol as the solvent is used. The resin component is burnt off at a temperature of 350° C.-400° C.

The compositional ratio in the silver paste is set in such a manner that the content ratio of glass frit after baking is between 1 wt % and 12 wt %. A content ratio of 1 wt % is the minimum content ratio that causes the electrodes to be fixed to the glass substrate by baking. If the content ratio exceeds 12 wt %, then the shape of the electrodes will be deformed as the electrodes are formed by baking simultaneously with dielectric layer, and there is also a risk that the resistance value will deteriorate. Therefore, an upper limit of 12 wt % is set for the content ratio of glass frit.

In this embodiment, the ratios of the silver powder, glass frit and organic binder in the silver paste are set to 70 wt % of silver powder, 5 wt % of glass frit and 25 wt % of organic binder.

Address electrode patterns 2 are formed using this silver paste, by means of screen printing, for example. More specifically, using a screen plate made of SUS 325 mesh and having an emulsion thickness of 10 μm, patterns are printed directly onto the rear surface glass substrate 1 in such a manner that the width of the electrodes is approximately 130 μm.

After that, the solvent in the organic binder is removed by drying at a temperature of approximately 150° C.

The rear surface glass substrate 1 formed with address electrode patterns 2 in this manner is inspected using an image inspection device which detects faults by means of image recognition.

Upon actually inspecting an sample by means of this image inspection device, the inventors found no faults at all.

Then, disconnections and shorting to adjacent electrodes are checked by passing a current through the address electrode patterns 2, using an electrical inspection device. This electrical inspection device detects disconnection of electrodes or shorting to adjacent electrodes by touching a probe against each of the electrodes and passing a weak current through them.

As a result of inspecting the aforementioned sample using an electrical inspection device of this kind, the inventors discovered a line resistance value of approximately 300 kΩ in all but one electrode, and a line resistance value of approximately 100 MΩ in one electrode. Therefore, it could be recognized that the address electrode patterns 2 showing a resistance of approximately 100 MΩ was in a disconnected state. Accordingly, the silver paste used in the printing process was coated onto the point of the disconnection, allowed to dry, and the electrode pattern was then tested again using the electrical inspection device. On this occasion, the resistance value was approximately 300 kΩ, thus indicating that the disconnection has been repaired completely.

Next, as shown in FIG. 1C, a dielectric layer pattern 3 is formed using a glass paste for forming a white dielectric layer, so as to cover the address electrode pattern 2. The dielectric layer pattern 3 is formed over the address electrode patterns 2, with the exception of the terminal sections where the address electrodes are connected to an external circuit.

A glass paste containing glass frit and an organic binder is used.

ZnO type glass frit having a softening point of approximately 540° C. is used as the glass frit, and an organic binder having a cellulose or acrylic material as the resin component and BCA or α-terpinenol as the solvent is used. $TiO_2$ is added to the resin component in order to achieve a white color. The resin component is burnt off at a temperature of 350° C.-450° C.

The dielectric layer pattern 3 is formed by screen printing, for example, using this glass paste. Then, the solvent component in the organic binder is removed by drying.

Next, the address electrode patterns 2 and the dielectric layer pattern 3 are baked at a baking temperature between a temperature (lower limit) equal to or higher than a temperature 20° C. below the softening point of the glass frit in the glass paste and a temperature (upper limit) equal to or lower than a temperature 10° C. above this softening point. If the baking temperature exceeds a temperature 10° C. above the softening point, then a large number of bubbles are generated and there is a risk that the glass will crystallize. In this embodiment, the baking temperature is set to 540° C.

Accordingly, the resin components in the address electrode pattern 2 and the dielectric layer pattern 3 are burnt away, the glass frit components are softened and become fixed to the rear surface glass substrate 1. As illustrated in FIG. 2, therefore, address electrodes 4 and a white dielectric layer 5 are formed on the rear surface glass substrate 1.

By means of this baking process, the ratios of the silver powder and the glass frit in the address electrode 4 become approximately 93 wt % for the silver powder and approximately 7 wt % for the glass frit.

When the address electrode patterns 2 and the dielectric layer pattern 3 were baked simultaneously at a temperature of 540° C., and the resistance of the address electrodes 4 thus formed on the rear surface glass substrate 1 was measured by the inventors in the aforementioned sample, a resistance value of 14 Ω was obtained, as indicated in Table 2. On the other hand, in the case of a sample formed by baking the address electrodes and the white dielectric layer separately, the line resistance values of the individual address electrodes prior to forming the white dielectric layer and the address electrodes after forming the white dielectric layer were respectively measured to be 18 Ω and 17 Ω, as indicated in Table 2.

TABLE 2

| Resistance values of address electrodes | | |
|---|---|---|
| Individual baking of address electrodes and | Resistance value of individual address electrodes | 18 Ω |

TABLE 2-continued

| Resistance values of address electrodes | | |
|---|---|---|
| white dielectric layer | Resistance value of address electrodes after forming white dielectric layer | 17 Ω |
| Simultaneous baking of address electrodes and white dielectric layer | | 14 Ω |

In this way, it can be seen that even if address electrodes 4 are formed by simultaneously baking the address electrode patterns 2 and the dielectric layer pattern 3, the functions of the address electrodes 4 are maintained satisfactorily in comparison to a case where the address electrodes and the white dielectric layer are baked and formed separately.

Next, partitions 6 are formed in a stripe fashion on the white dielectric layer 5 in order to demarcate discharge cells. The partitions 6 are formed, for example, by coating a partition-forming glass paste to approximately 150 μm on the rear surface glass substrate 1 formed with address electrodes 4 and the white dielectric layer 5, by means of reverse coating, slit coating, or the like, then drying the rear surface glass substrate 1 and performing so-called "sandblasting". Here, the glass paste containing a mixture of glass frit, organic binder and $TiO_2$ is used.

Next, a fluorescent layer 7 is formed between the partitions 6, 6. The fluorescent layer 7 includes a red fluorescent layer 7*r*, a green fluorescent layer 7*g* and a blue fluorescent layer 7*b*, which convert the ultraviolet light generated by discharge of the discharge gas into visible light. Then, a sealing frit, for example, is coated onto the outer perimeter of the rear surface glass substrate 1 and is baked to complete the rear surface substrate 8.

The front surface substrate, on the other hand, is manufactured by a conventional method. In other words, as shown in FIG. 2, transparent electrodes 12*a* and 13*a* are formed in a parallel fashion in the horizontal direction H, on the inner surface of the front surface glass substrate 11. The transparent electrodes 12*a* and 13*a* are made of tine oxide, ITO (Indium Tin Oxide), or the like.

Next, bus electrodes (trace electrodes) 12*b* and 13*b* for reducing the resistance value are formed in the horizontal direction H, on the lower face of the transparent electrodes 12*a* and 13*a*. In this way, a scanning electrode 12 and a sustaining electrode (common electrode) 13 are formed by the transparent electrodes 12*a* and 13*a* and the bus electrodes 12*b* and 13*b*.

Then, a transparent dielectric layer 14 for covering the scanning electrode 12 and the sustaining electrode 13 are formed. The transparent dielectric layer 14 is made of a low-melting-point glass, such as a PbO (lead oxide) glass, or the like.

A protective film 15 for protecting the transparent dielectric layer from discharges is then formed. The protective film 15 is made of MgO (magnesium oxide), or the like. In this way, the front surface substrate 16 is completed.

Next, the front surface substrate 16 and the rear surface substrate 8 are placed in opposing positions, separated from each other by a gap of 100 μm approximately, and they are bonded together in such a manner that the extending direction of the electrode pairs 17 (row direction) and the extending direction of the address electrodes 4 (column direction) are orthogonal to each other and in such a manner that a discharge space is formed between the two substrates 16 and 8. The perimeter section of the bonded substrates is sealed hermetically by means of a sealing material, such as frit glass. More specifically, frit glass is coated onto the perimeter section of the rear surface substrate 8, then the front surface substrate 16 and the rear surface substrate 8 are heated in their bonded state, thereby causing the frit glass to melt and causing the front surface substrate 16 and the rear surface substrate 8 to join together in the form of a panel.

Next, the front surface substrate 16 and the rear surface substrate 8 forming a panel are introduced into a heating oven, an air pipe is connected to the discharge space formed between the front surface substrate 16 and the rear surface substrate 8, and the substrates are heated in vacuum conditions, while expelling air from the discharge space.

A discharge gas consisting of a mixed rare gas containing xenon, for example, is introduced into the discharge space at a prescribed pressure, thereby filling the discharge space, and then the air pipe is sealed by overheating, thus closing off the open end of the pipe. In this way, discharge gas is filled into the discharge space.

Next, an ageing process is carried out. More specifically, an electrical discharge is generated inside the discharge cells and the discharge is continued for a prescribed period of time in order that the discharge becomes stable.

In this way, discharge gas is filled into the discharge gas space 104 and a plasma display panel 18 is completed.

The inventors carried out a further electrical inspection of the address electrodes 4 in the plasma display panel 18, and they discovered no disconnections at all. Furthermore, the display quality was equivalent to that obtained by means of a conventional method.

As understood from the foregoing, this embodiment can reduce the time required for baking, by using simultaneous baking.

In addition, since suitable values are selected for the content ratio of glass frit in the silver paste and the average particle size of the silver powder used in the silver paste, the address electrode patterns 2 are able to show (have) conductivity when they are dried, and therefore electrical inspection of the address electrodes can be carried out, for example, before forming the dielectric layer pattern 3. If any faults, such as disconnected electrodes, are revealed by this inspection, then these faults can be repaired. Consequently, it is possible to prevent a decline in production yield.

Since a glass frit having a softening point equal to or below that of the glass frit in the glass paste is used in the silver paste, any gas generated during the baking process due to burning of the organic binder contained in the address electrode patterns 2, in particular, is prevented from becoming sealed into the dielectric layer pattern 3 covering the address electrode patterns 2 and from remaining trapped inside the dielectric layer in the form of gas bubbles. Therefore, the possibility of voltage resistance faults in the dielectric layer when the display panel displays an image can be suppressed.

By setting a suitable value for the content ratio of glass frit in the silver paste, it is possible to prevent discoloration of the dielectric layer, regardless of the type of glass frit contained in the silver paste, for example, and hence good display quality can be maintained.

Second Embodiment

Figure 11:
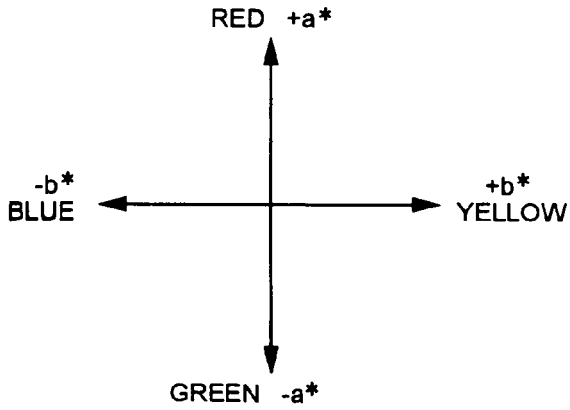
FIG. 11 is a diagram for describing the characteristics of colored light from a plasma display apparatus using the plasma display panel.
Figure 12:
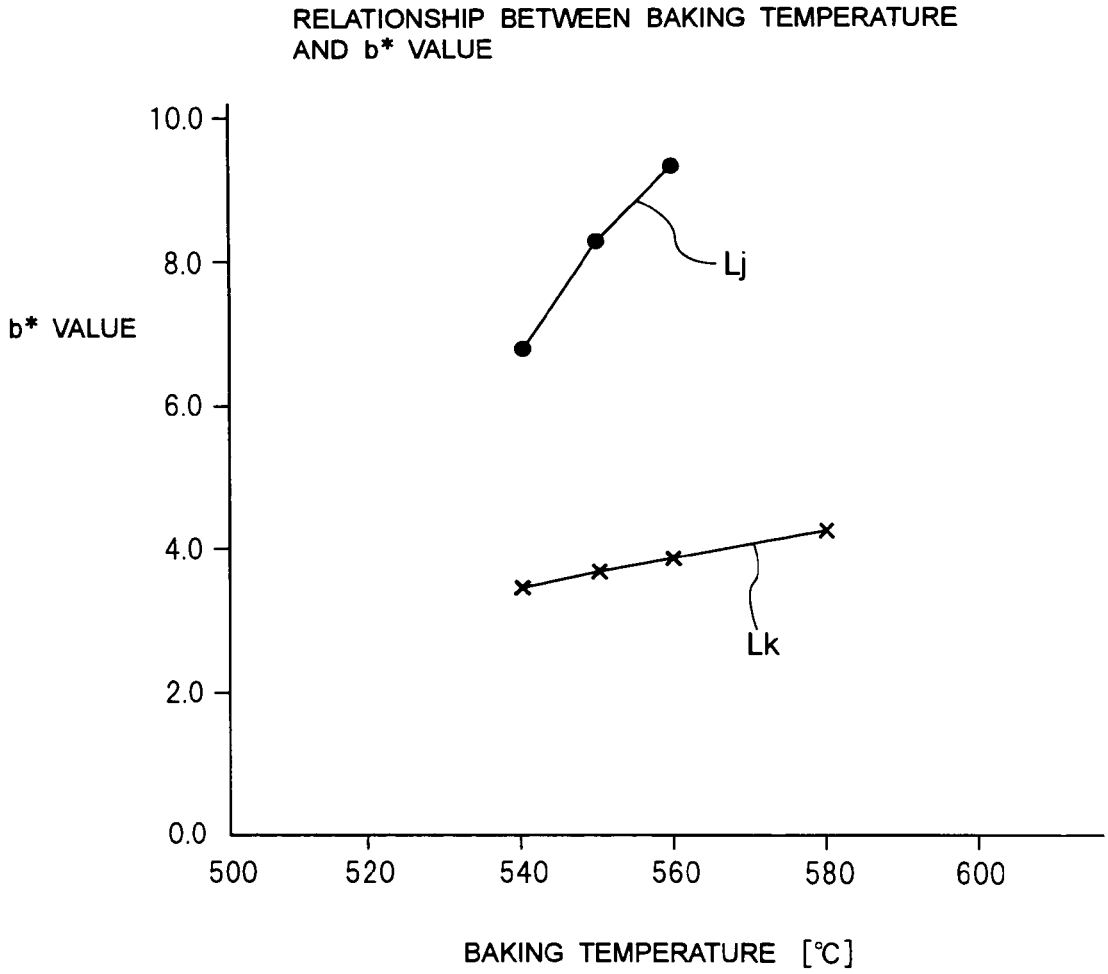
FIG. 12 is a diagram showing the relationship between the baking temperature and the b* value of the front surface substrate.

FIG. 6A to FIG. 6D are a series of process diagrams for describing a method of manufacturing a plasma display panel according to a second embodiment of the present invention. FIG. 7 to FIG. 10 show the relationship between the baking conditions and transmissivity of the front surface substrate, respectively. FIG. 11 illustrates the characteristics of colored light from a plasma display apparatus using the plasma display panel. FIG. 12 shows the relationship between the baking temperature and the b* value of the front surface substrate.

The main point of difference of this embodiment with respect to the first embodiment lies in the fact that in the manufacture of the front surface substrate, appropriate manufacturing conditions are established with regard, for instance, to the content of glass frit in the silver paste, the relationship between the softening points of the glass frit in the silver paste and the glass paste, the average particle size of the silver powder, and the like, whereas the rear surface substrate is manufactured by means of a conventional method which does not use simultaneous baking.

Apart from this difference, the second embodiment is approximately the same as the first embodiment, and hence only a brief description is given to the same or similar parts in the second embodiment.

Figure 6A:
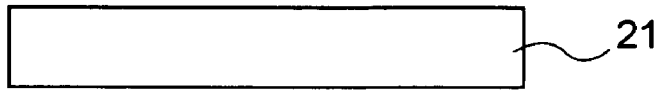
FIG. 6A to FIG. 6D are a series of process diagrams for describing a method of manufacturing a plasma display panel according to a second embodiment of the present invention.

Firstly, as shown in FIG. 6A, a front surface glass substrate 21 is prepared. A glass having a high strain point, for example, is used for the front surface glass substrate 21, but the type of glass used is not limited in particular.

Figure 6B:
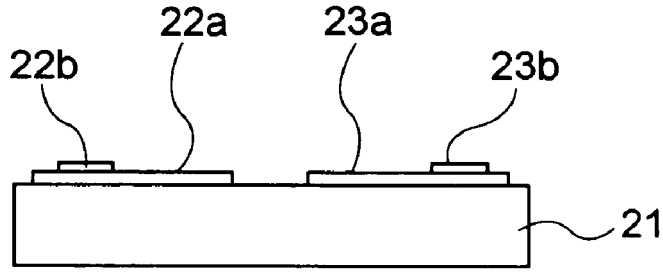

Then, as shown in FIG. 6B, transparent electrodes 22*a* and 23*a* are formed in a parallel fashion in the horizontal direction (corresponding to the horizontal direction H in FIG. 2), on the front surface glass substrate 21. The transparent electrodes 12*a* and 13*a* are formed by depositing ITO (Indium Tin Oxide), for example, on the full surface of the front surface glass substrate 21, by sputtering, or the like, and then carrying out etching.

Next, bus electrodes for reducing the electrical resistance are formed in the horizontal direction H, in such a manner that they make contact at least partially with the transparent electrodes 22*a* and 23*a*. In the illustrated embodiment, the bus electrodes have a two-layer structure.

Therefore, black bus electrode layer patterns 22*b* and 23*b* are formed on the transparent electrodes 22*a* and 23*a*, using a conductive paste for forming a black bus electrode layer.

A black paste is used for this conductive paste in order to suppress reflection of external light and improve the contrast of the panel, since the bus electrodes are formed on the front surface substrate. The conductive paste is prepared by combining ruthenium oxide, which is an inorganic conductive black pigment, with a glass frit and an organic binder, and forming the mixture into a paste.

In this embodiment, glass frit having a softening point equal to or below that of the glass frit in the glass paste is used. For example, the glass frit is $Bi_2O_3$ type glass frit having a softening point of approximately 420° C.

An organic binder having a cellulose or acrylic material as the resin component and BCA or α-terpinenol as the solvent is used. The resin component is burnt off at a temperature of 350° C.-400° C.

Using this conductive paste, the black bus electrode layer patterns 22*b* and 23*b* are formed by means of screen printing, for example.

Then, the solvent in the organic binder is removed by drying at a temperature of approximately 150° C.

Figure 6C:
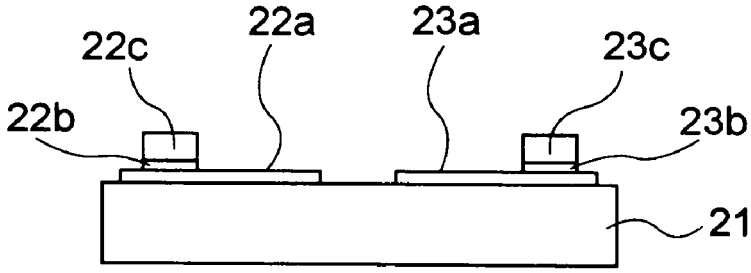

As shown in FIG. 6C, silver bus electrode layer patterns 22*c* and 23*c* are deposited on the black bus electrode layer patterns 22*b* and 23*b*, using silver paste for forming a silver bus electrode layer, in order to reduce the overall resistance and cause the layers to function as bus electrodes.

For this silver paste, a combination of silver powder and an organic binder formed into a paste is used.

Silver powder having an average particle size between 0.001 μm and 5 μm is used. Since the bus electrodes have a height of about 5 μm-7 μm in order to reduce the resistance value and correspond to the shape of the dielectric layer, the upper limit of the average particle size of the silver powder is set to 5 μm. In this embodiment, silver powder having an average particle size of approximately 1 μm is used. Glass frit is not used because the average particle size of the silver powder is relatively large.

An organic binder having a cellulose material or acrylic material as a resin component and BCA or α-terpinenol as the solvent is used. The resin component is burnt off at a temperature of 350° C.-400° C.

Using this silver paste, the silver bus electrode layer patterns 22*c* and 23*c* are deposited on the black bus electrode layer patterns 22*b* and 23*b*, by means of screen printing, for example.

Then, the solvent in the organic binder is removed by drying at a temperature of approximately 150° C.

Next, the front surface glass substrate 21 formed with the transparent electrodes 22*a* and 23*a*, black bus electrode layer patterns 22*b* and 23*b*, and silver bus electrode layer patterns 22*c* and 23*c* is inspected using an image inspection device for detecting faults by means of image recognition.

When the inventors inspected samples using an image inspection device of this kind, they confirmed the presence of faults caused by the mesh of the screen plate, but none of these faults were large to require repair.

Then, disconnections and shorting to adjacent electrodes are inspected using an electrical inspection device, which passes current through the transparent electrodes 22*a* and 23*a*, the black bus electrode layer patterns 22*b* and 23*b* and the silver bus electrode layer patterns 22*c* and 23*c*.

Upon inspecting the samples by using an electrical inspection device, the inventors discovered an average line resistance in the electrodes of approximately 10 MΩ. Some lines showed resistance values exceeding 100 MΩ. Hence, disconnections in the electrodes in these lines were re-examined. The examination revealed some disconnections which could not be identified by image inspection. Silver paste was coated onto the disconnected parts and allowed to dry, and then the electrical inspection was carried out again. In this instance, all the lines had a resistance value of 10 MΩ, and hence repair of the disconnections was completed.

Figure 6D:
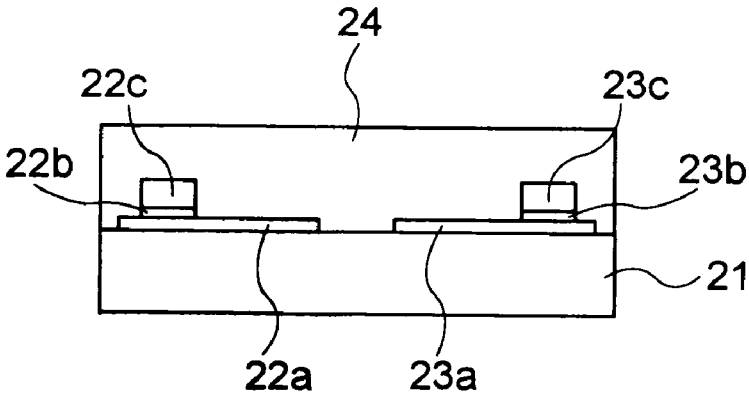

Next, as shown in FIG. 6D, a transparent dielectric layer pattern 24 is formed using a glass paste for forming a transparent dielectric layer, in such a manner that this pattern 24 covers the transparent electrodes 22*a* and 23*a*, the black bus electrode layer patterns 22*b* and 23*b*, and the silver bus electrode layer patterns 22*c* and 23*c*, with the exception of the terminal sections where the electrodes are connected to an external circuit.

A glass paste containing glass frit and an organic binder formed into a paste is used.

A PbO type glass frit or a ZnO type glass frit, both having a softening point of approximately 540° C., is used. The organic binder contains a cellulose material or acrylic material as a resin component, and BCA or α-terpinenol as a solvent. The resin component is burnt away at a temperature of 350° C.-400° C.

Using this glass paste, a transparent dielectric layer pattern 24 is formed by means of screen printing, for example. The solvent in the organic binder is then removed by drying.

Then, the black bus electrode layer patterns 22*b* and 23*b*, the silver bus electrode layer patterns 22*c* and 23*c*, and the transparent dielectric layer pattern 24 are baked at a temperature between a value 20° C. below the softening point of the glass frit in the glass paste and a value 10° C. above this softening point.

If the baking temperature is lower than 20° C. below the softening point of the glass frit in the glass paste, then the paste will not be baked sufficiently, and if the baking temperature is higher than 10° C. above the softening point, then small bubbles will develop, thus impairing the transmissivity of the front surface glass substrate, for example. In this embodiment, the baking temperature is set to approximately 530° C., and the holding time for which this baking temperature is maintained is set to approximately 30 minutes.

Accordingly, the resin components in the black bus electrode layer patterns 22*b* and 23*b*, the silver bus electrode layer patterns 22*c* and 23*c*, and the transparent dielectric layer pattern 24 are burnt off, and the glass frit component is softened and fixed onto the front surface glass substrate 21. In this way, the transparent electrodes 22*a* and 23*a*, bus electrodes consisting of black bus electrode layers and silver bus electrode layers, and a transparent dielectric layer are formed on the front surface glass substrate 21.

By means of this baking process, the ratios of the silver powder and the glass frit in the address electrodes 4 become approximately 93 wt % for the silver powder and approximately 7 wt % for the glass frit.

The inventors measured the line resistance of electrodes (the transparent electrodes 22*a* and 23*a*, and the bus electrodes) in a sample where the electrodes were formed on the front surface glass substrate 21 by simultaneously baking the black bus electrode layer patterns 22*b* and 23*b*, the silver bus electrode layer patterns 22*c* and 23*c*, and the transparent dielectric layer pattern 24, at a temperature of 550° C. As shown in Table 3, the measured line resistance was 41 Ω. On the other hand, when a sample was formed by separate baking of the electrodes (bus electrodes) and the transparent dielectric layer, and the respective line resistances were measured for the independent electrodes (transparent electrodes 22*a* and 23*a*, and the bus electrodes) before forming the transparent dielectric layer, and the electrodes (transparent electrodes 22*a* and 23*a*, and the bus electrodes) after forming the transparent dielectric layer, then resistance values of 53 Ω and 50 Ω were obtained respectively, as shown in Table 3.

TABLE 3

| Resistance values in electrodes | | |
|---|---|---|
| Individual baking of electrodes and dielectric layer | Resistance value of individual electrodes | 53 Ω |
| | Resistance value of electrodes after forming dielectric layer | 50 Ω |
| Simultaneous baking of electrodes and dielectric layer | | 41 Ω |

It can be seen that even if electrodes (bus electrodes) are formed by simultaneously baking the black bus electrode layer patterns 22*b* and 23*b*, silver bus electrode layer patterns 22*c* and 23*c*, and a transparent dielectric layer pattern 24, the functions of the electrodes can still be maintained satisfactorily compared to a case where the electrodes (bus electrodes) and the transparent dielectric layer are formed by separate baking processes.

The inventors also measured the transmissivity of the front surface substrate for different baking conditions (baking temperature and hold time) after forming the transparent dielectric layer, when a glass frit S1 having a softening point of 538° C. was used as the glass frit in the glass paste for forming the transparent dielectric layer.

Figure 7:
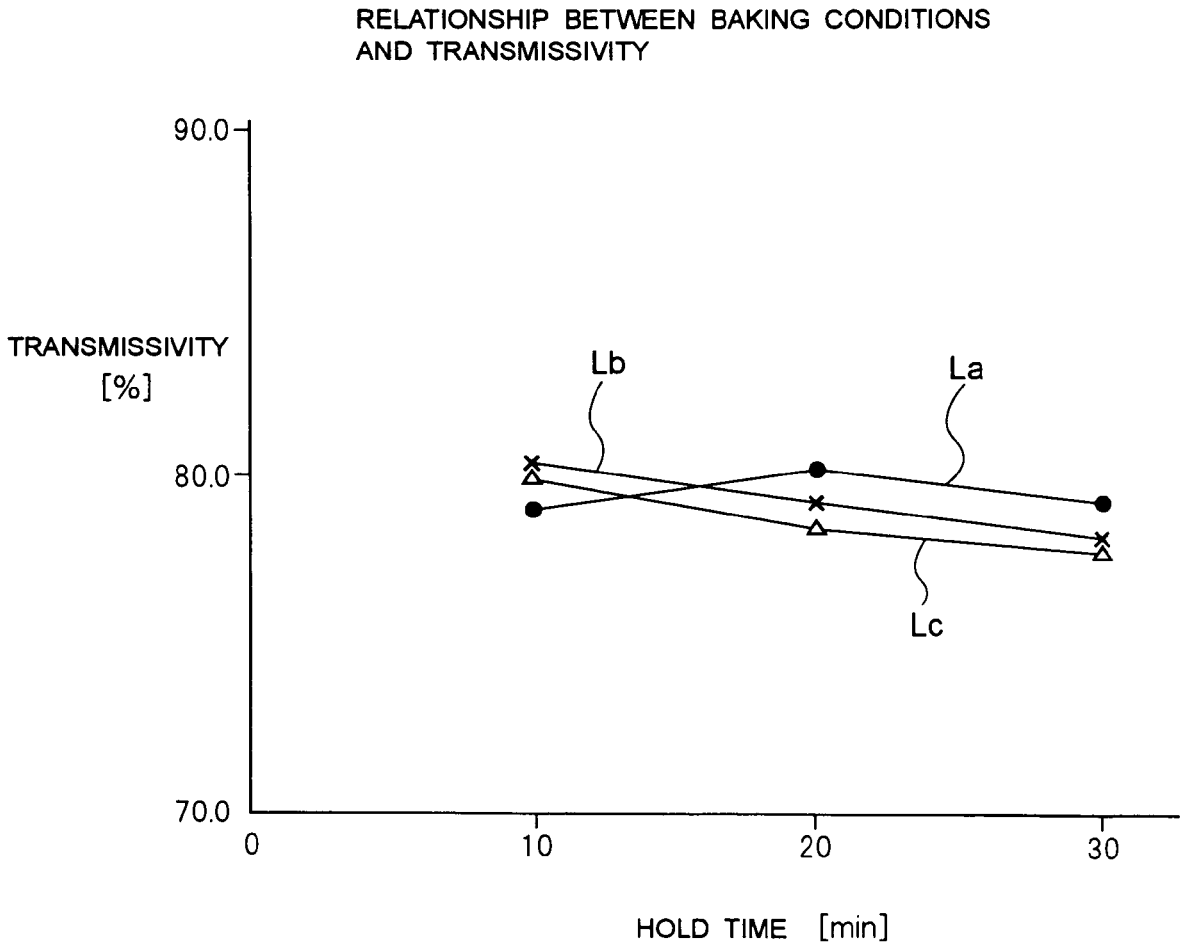
FIG. 7 is a diagram showing the relationship between the baking conditions and transmissivity of the front surface substrate.

More specifically, the transmissivity of the glass frit S1 was measured for respective baking temperatures of 530° C., 535° C. and 540° C., and respective hold times of 10 minutes, 20 minutes and 30 minutes. Light having a wavelength of 550 nm was used to determine the diffuse transmissivity converted to correspond to a film thickness of 30 μm. The results shown in Table 4 and FIG. 7 were obtained. In FIG. 7, the graphs $L_a$, $L_b$ and $L_c$ indicate the respective results for baking temperatures of 530° C., 535° C. and 540° C.

TABLE 4

| Transmissivity of front surface substrate | | |
|---|---|---|
| Baking conditions | | |
| Baking temperature (° C.) | Hold time (min) | Transmissivity (%) |
| 530 | 10 | 78.8 |
| | 20 | 80.0 |
| | 30 | 79.1 |
| 535 | 10 | 80.1 |
| | 20 | 79.0 |
| | 30 | 78.0 |
| 540 | 10 | 79.7 |
| | 20 | 78.2 |
| | 30 | 77.6 |

The measurement results in Table 4 and FIG. 7 reveal that when the hold time is set to 10 minutes, high transmissivity is obtained if baking is performed in the vicinity of the softening point (538° C.) or at a temperature slightly above the softening point. If the hold time is set to 30 minutes, high transmissivity is obtained if baking is performed at a temperature slightly below the softening point. Consequently, this indicates that there are optimum hold times corresponding to each baking temperature.

The transmissivity of the front surface substrate was also measured for different baking conditions (baking temperature and hold time), when other types of glass frit were used, namely, glass frits S2, S3 and S4.

More specifically, the transmissivity was measured respectively in the case of hold times of 10 minutes and 30 minutes, and baking temperatures of 520° C., 530° C., 540° C. and 550° C., when using a glass frit S2 (softening point: 540° C.) in the glass paste for forming the transparent dielectric layer. The diffuse transmissivity was determined by using light having a wavelength of 550 nm.

Figure 8:
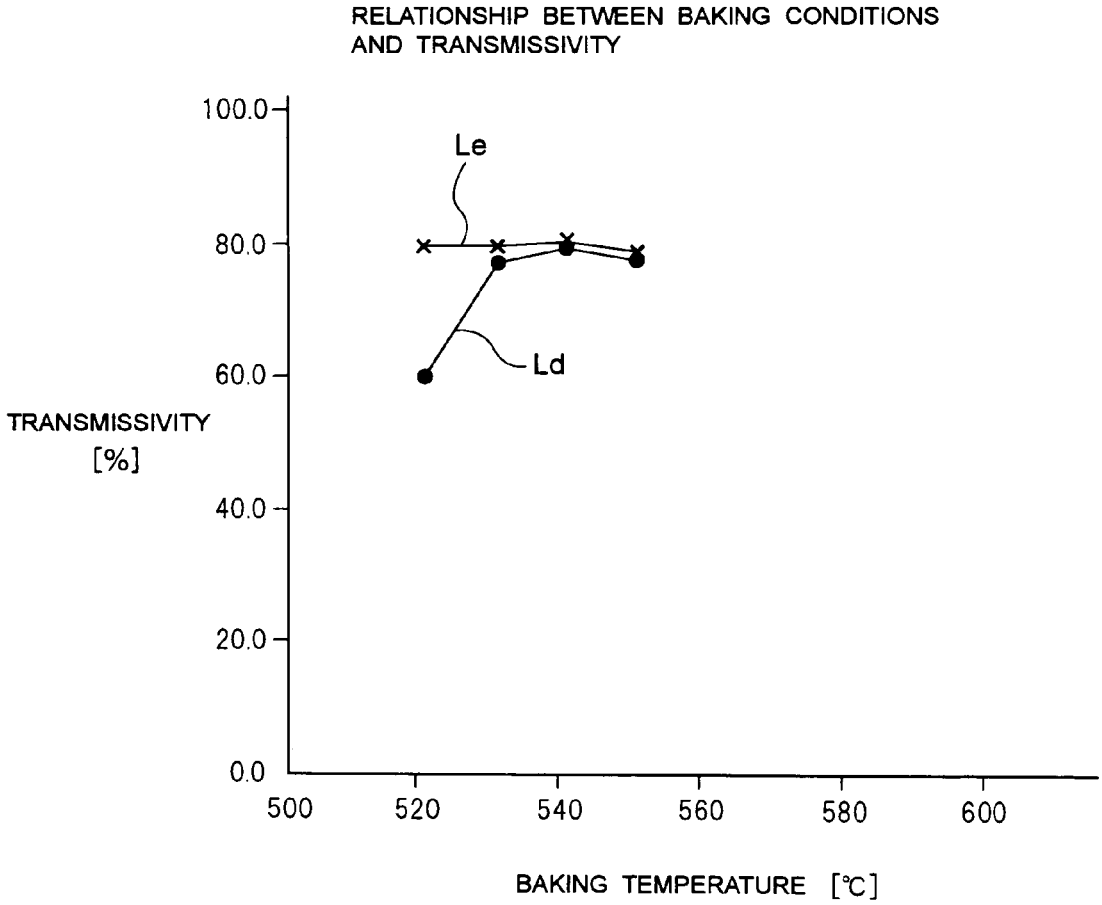
FIG. 8 is another diagram showing the relationship between the baking conditions and transmissivity of the front surface substrate.

The results shown in Table 5 and FIG. 8 were obtained. In FIG. 8, the graphs $L_d$ and $L_e$ show the respective results for hold times of 10 minutes and 30 minutes.

TABLE 5

| Transmissivity of front surface substrate | | | |
|---|---|---|---|
| Baking conditions | | Film | |
| Hold time (min) | Baking temp. (° C.) | thickness (μm) | Transmissivity (%) |
| 10 | 520 | 33 | 60.1 |
| | 530 | 33 | 77.0 |
| | 540 | 32 | 79.3 |
| | 550 | 34 | 78.0 |
| 30 | 520 | 32 | 79.4 |
| | 530 | 31 | 79.6 |
| | 540 | 31 | 80.0 |
| | 550 | 32 | 78.6 |

As the measurement results shown in Table 5 and FIG. 8 reveal, similar to the case of Table 4 and FIG. 7, when the hold time is set to 10 minutes, high transmissivity is obtained if baking is performed in the vicinity of the softening point (540° C.) or at a temperature slightly higher than the softening point. If the hold time is set to 30 minutes, then high transmissivity is obtained if baking is performed in the vicinity of the softening point or at a temperature slightly below the softening point.

As understood from the above, by setting the hold time to 30 minutes, the suitable range of the baking temperature is extended in the lower temperature region.

The inventors thought that the transmissivity declines on the lower temperature side of the softening point, and particularly if the hold time is set to 10 minutes, because baking is not completed adequately. The inventors also thought that the transmissivity declines at higher temperatures because minute bubbles develop as the baking progresses.

The transmissivity was measured respectively in the case of hold times of 10 minutes and 30 minutes, and baking temperatures of 540° C., 550° C., 560° C. and 570° C., when using a glass frit S3 (softening point: 570° C.) in the glass paste for forming the transparent dielectric layer. The diffuse transmissivity was determined by using light having a wavelength of 550 nm.

Figure 9:
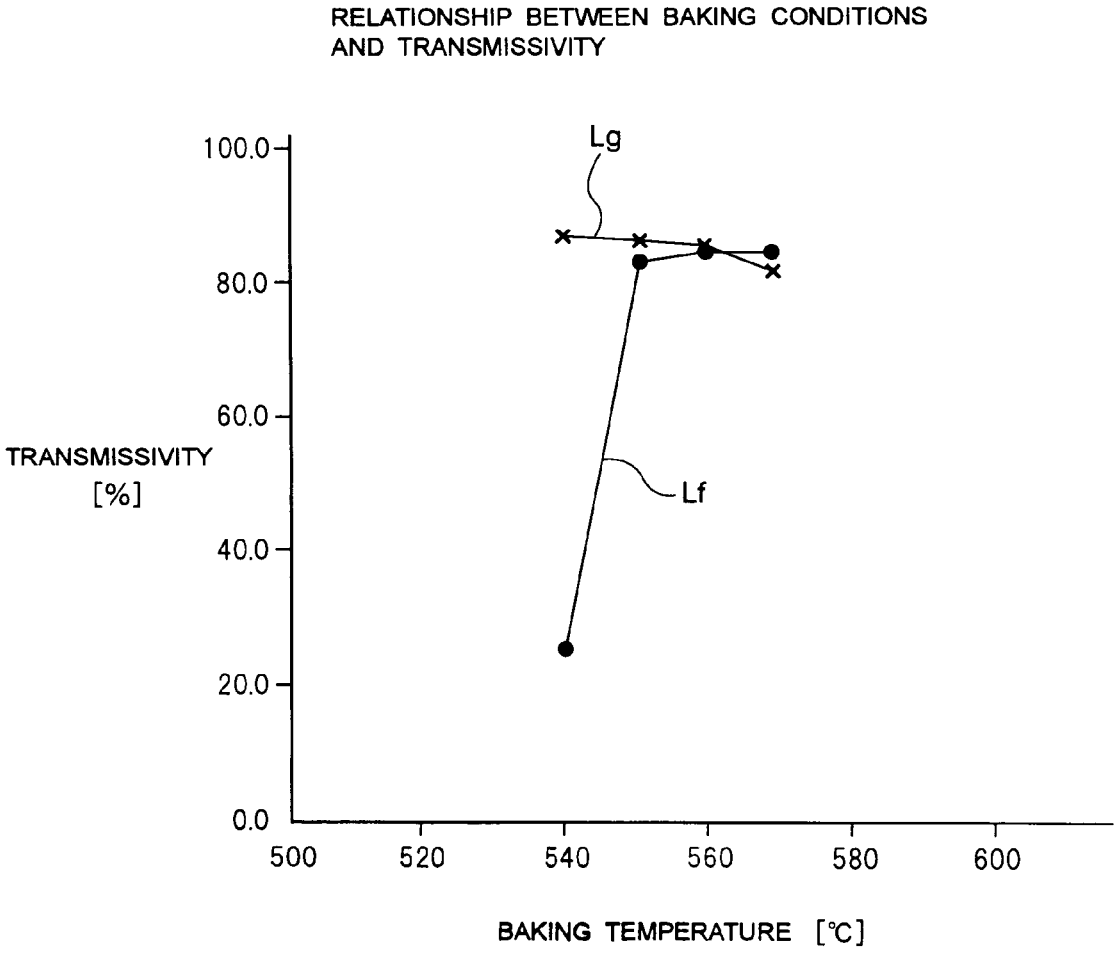
FIG. 9 is still another diagram showing the relationship between the baking conditions and transmissivity of the front surface substrate.

The results shown in Table 6 and FIG. 9 were obtained. In FIG. 9, the graphs $L_f$ and $L_g$ show the respective results for hold times of 10 minutes and 30 minutes.

TABLE 6

| Transmissivity of front surface substrate | | | |
|---|---|---|---|
| Baking conditions | | | |
| Hold time (min) | Baking temperature (° C.) | Film thickness (μm) | Transmissivity (%) |
| 10 | 540 | 37 | 25.6 |
| | 550 | 33 | 84.4 |
| | 560 | 32 | 86.4 |
| | 570 | 33 | 86.1 |
| 30 | 540 | 31 | 88.7 |
| | 550 | 33 | 87.7 |
| | 560 | 31 | 87.0 |
| | 570 | 33 | 83.5 |

As the measurement results shown in Table 6 and FIG. 9 reveal, when the hold time is set to 10 minutes, high transmissivity is obtained if baking is performed in the vicinity of the softening point. If the hold time is set to 30 minutes, then high transmissivity is obtained if baking is performed at a temperature slightly below the softening point.

Thus, by setting the hold time to 30 minutes, the suitable range for the baking temperature is extended in the low temperature region.

It is thought that the transmissivity declines on the lower temperature side of the softening point, and particularly if the hold time is set to 10 minutes, because baking is not completed adequately.

The transmissivity was measured respectively in the case of hold times of 10 minutes and 30 minutes, and baking temperatures of 560° C., 570° C., 580° C. and 590° C., when using a glass frit S4 (softening point: 570° C.) in the glass paste for forming the transparent dielectric layer. The diffuse transmissivity was determined by using light having a wavelength of 550 nm.

Figure 10:
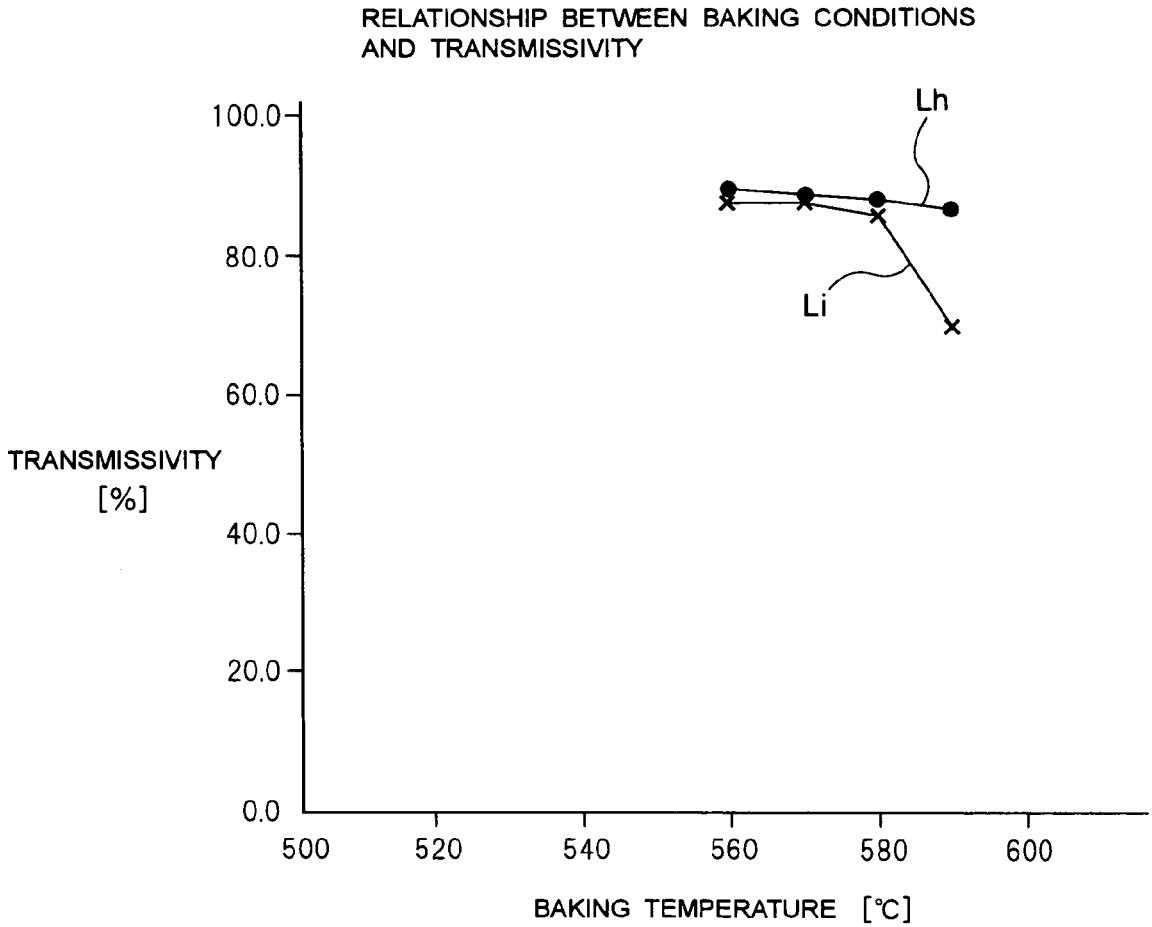
FIG. 10 is another diagram showing the relationship between the baking conditions and transmissivity of the front surface substrate.

The results shown in Table 7 and FIG. 10 were obtained. In FIG. 10, the graphs $L_h$ and $L_i$ show the respective results for hold times of 10 minutes and 30 minutes.

TABLE 7

| Transmissivity of front surface substrate | | | |
|---|---|---|---|
| Baking conditions | | | |
| Hold time (min) | Baking temperature (° C.) | Film thickness (μm) | Transmissivity (%) |
| 10 | 560 | 28 | 90.5 |
| | 570 | 31 | 89.7 |
| | 580 | 30 | 89.7 |
| | 590 | 30 | 88.5 |
| 30 | 560 | 30 | 89.5 |
| | 570 | 32 | 89.0 |
| | 580 | 31 | 87.6 |
| | 590 | 32 | 71.1 |

As the measurement results shown in Table 7 and FIG. 10 reveal, when the hold time is set to 30 minutes, high transmissivity is obtained if baking is performed in the vicinity of the softening point or at a temperature slightly lower than the softening point.

It is thought that the transmissivity declines on the higher temperature side of the softening point, and particularly if the hold time is set to 30 minutes, because of clouding of the glass.

After the transparent dielectric layer had been formed, the inventors also measured the b* value of the front surface substrate, which is a quantitative psychological measure of chromaticity, according to the type of glass frit contained in the glass paste for forming the transparent dielectric layer (PbO type frit or ZnO type frit).

As a result, as shown in Table 8, the b* value was measured to be 2.8 when PbO type glass frit was used, and the b* value was measured to be 4.0 when ZnO type glass frit was used.

TABLE 8

| b* value of front surface substrate | | |
|---|---|---|
| | Softening point | b* value |
| Dielectric layer made of PbO type glass frit | 540° C. | 2.8 |
| Dielectric layer made of ZnO type glass frit | 540° C. | 4.0 |

In quantitative psychological color analysis, the characteristics of the colored light from a display are indicated by one point in a color space, using the perceived brightness L* and the perceived color characteristics (a*, b*). In the coordinate system indicating color light characteristics in terms of L* and (a*, b*) shown in FIG. 11, the b* value indicates the degree of yellow coloring. The L* value is a coordinate in a perpendicular direction to the plane of the drawing sheet. The b* value indicates a greater level of yellow color, the greater the value in the positive direction.

Normally, when silver is baked onto a glass, the glass turns yellow in color. Since the dielectric layer also contains glass frit, the silver will disperse into the transparent dielectric layer upon baking and hence the dielectric layer will turn yellow, if the conventional manufacturing method is employed.

In this embodiment, on the contrary, since the manufacturing conditions, such as the content ratio of the glass frit in the silver paste, the relationship between the softening points of the glass frits in the silver paste and the glass paste, and the baking temperature, are set to appropriate values, yellow coloration is suppressed, even if simultaneous baking is used.

The inventors measured the b* value of the front surface substrate using the same type of glass frit (PbO type frit), while varying the softening point only. As a result, as shown in Table 9, the b* value was measured to be 2.8 when glass frit with a softening point of 540° C. was used, and the b* value was measured to be 6-8 when glass frit with a softening point of 480° C. was used.

TABLE 9 b* value of front surface substrate

| | Softening point | b* value |
|---|---|---|
| Dielectric layer of PbO type glass frit (frit used in the present embodiment) | 540° C. | 2.8 |
| Dielectric layer of PbO type glass frit (frit used in previous investigation) | 480° C. | 6–8 |

It can be seen that when the glass frit chosen in this embodiment was used, the yellow coloration was suppressed. On the other hand, in a substrate using glass frit with a softening point of 480° C., the silver is dispersed within the dielectric layer, and various problems arise in addition to yellow coloration. From experimentation, it has been confirmed that there is no problem in relation to display quality provided that the b* value is 5 or less.

The inventors measured the b* value of the front surface substrate at different baking temperatures, in the case of glass frits S5 and S6 used in the glass paste for forming a transparent dielectric layer.

More specifically, the b* value of the front surface substrate was measured for a glass frit S5 at baking temperatures of 540° C., 550° C. and 560° C. The results shown in Table 10 and FIG. 12 were obtained.

In FIG. 12, the graphs $L_j$ and $L_k$ show the respective measurement results for the glass frits S5 and S6.

TABLE 10 b* value of front surface substrate

| Baking temperature | b* value |
|---|---|
| 540° C. | 6.8 |
| 550° C. | 8.3 |
| 560° C. | 9.2 |

The b* value of the front surface substrate was measured for a glass frit S6 at baking temperatures of 540° C., 550° C., 560° C. and 580° C. The results shown in Table 11 and FIG. 12 were obtained.

TABLE 11 b* value of front surface substrate

| Baking temperature | b* value |
|---|---|
| 540° C. | 3.4 |
| 550° C. | 3.6 |
| 560° C. | 3.8 |
| 580° C. | 4.2 |

From the measurement results in Table 10, Table 11 and FIG. 12, it can be seen that the lower the baking temperature, the better the b* value, and hence the greater the extent to which the yellow coloration can be suppressed.

Next, a protective film for protecting the transparent dielectric layer from discharges is formed. The protective film is made of MgO (magnesium oxide), or the like. In this way, the front surface substrate is completed.

The rear surface substrate, on the other hand, is manufactured by means of a conventional method.

Then, the front surface substrate and the rear surface substrate are placed in opposing positions, separated from each other by a gap, and they are bonded together in such a manner that the extending direction of the electrode pairs (row direction) and the extending direction of the address electrodes (column direction) are orthogonal to each other and in such a manner that a discharge space is formed between the two substrates. The perimeter section of the substrates is sealed hermetically by means of a sealing material, such as frit glass. More specifically, frit glass is coated onto the perimeter section of the rear surface substrate, and then the front surface substrate and the rear surface substrate are heated in their bonded state, thereby causing the frit glass to melt and causing the front surface substrate to join the rear surface substrate in the form of a panel.

Next, the front surface substrate and the rear surface substrate forming a panel are introduced into a heating oven, an air pipe is connected to the discharge space formed between the front surface substrate and the rear surface substrate, and the substrates are heated in vacuum conditions, while expelling air from the discharge space.

A discharge gas is introduced into the discharge space, thereby filling the discharge space, and the air pipe is then sealed by overheating, thus closing off the open end of the pipe. In this way, discharge gas is filled into the discharge gas space.

Thus, the plasma display panel is completed.

The inventors carried out a further electrical inspection of the bus electrodes, and they discovered no disconnections at all. The display quality was also equivalent to that obtained by means of a conventional method.

According to the embodiment, it is possible to obtain substantially similar advantages to those of the first embodiment.

Further, since the silver paste and the glass paste are baked at a suitable baking temperature, a glass frit in the sliver paste has a softening point below that of the glass frit in the glass paste, and the content ratio of the glass frit in the silver paste is set to a suitable value, it is possible to prevent dispersion of silver into the dielectric layer during baking, and hence discoloration of the dielectric layer can be avoided and good display quality can be maintained.

In particular, it is possible to obtain high transmissivity by setting the baking temperature in the vicinity of the softening point. Also, by setting the hold time to a relatively long time (for example, 30 minutes), the range of the suitable baking temperature can be extended on the lower temperature side. Thus, by setting the baking temperature to a relatively low temperature, it is possible to suppress yellow coloration.

Since glass frit is not contained in the silver paste used when forming the silver bus electrode layer patterns (upper layer), it is sufficient to use silver powder having an average particle size between 0.001 μm and 5 μm, and hence material costs can be reduced and manufacturing costs can be reduced.

Third Embodiment

Figure 13A:
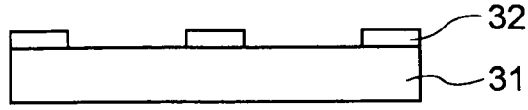
FIG. 13A to FIG. 13E are a series of process diagrams showing a method of manufacturing a plasma display panel according to a third embodiment of the invention.
Figure 13B:
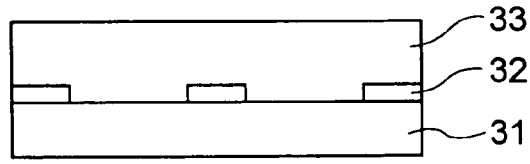
Figure 13C:
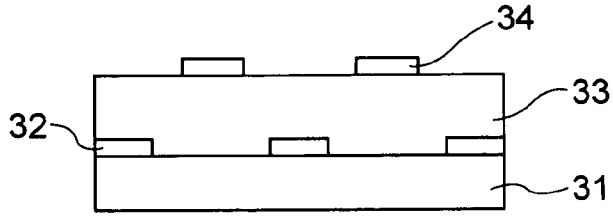
Figure 13D:
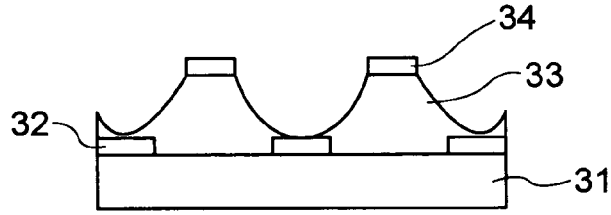
Figure 13E:
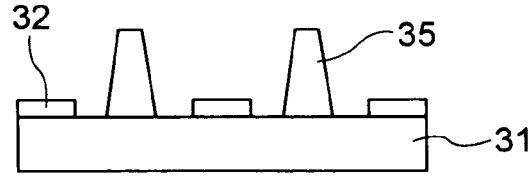
Figure 14:
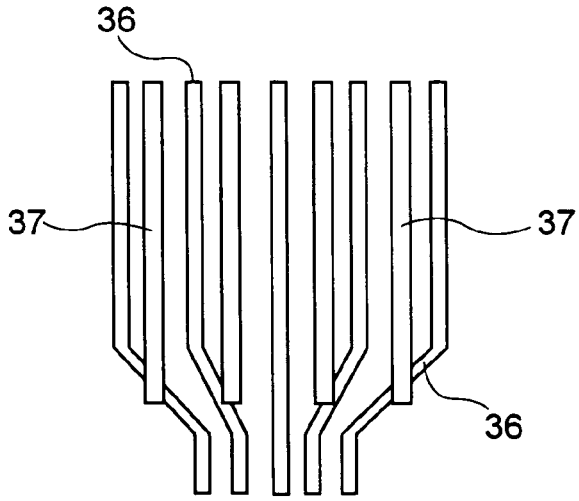
FIG. 14 is a plan view schematically showing the composition of the rear surface substrate of the plasma display panel according to the third embodiment.

FIG. 13A to FIG. 13E are a series of process diagrams showing a method of manufacturing a plasma display panel according to a third embodiment of the invention, and FIG. 14 is a plan diagram schematically depicting the composition of the rear surface substrate of this plasma display panel.

The major difference between this embodiment and the first embodiment lies in the fact that the partitions are also formed simultaneously by baking.

With this exception, the third embodiment is substantially the same as the first embodiment, and hence only a brief description is given to common parts.

In the method of manufacturing the plasma display panel according to this embodiment, firstly, a rear surface glass substrate 31 is prepared as illustrated in FIG. 13A. Similar to the first embodiment, glass having a high strain point, for example, may be used for the rear surface glass substrate 31, but the type of glass used is not limited in particular.

Next, as shown in FIG. 13A, address electrode patterns 32 are formed on the upper surface of the rear surface glass substrate 31 in parallel to the vertical direction, by using a silver paste for forming address electrodes.

Here, as shown in FIG. 14, the intervals between the address electrode patterns 32 are caused to become narrower in the vicinity of the terminal section where the address electrodes are connected to an external circuit. In a subsequent process, partitions 37 are formed in such a manner that their end portions make contact with the address electrodes 36.

A silver paste containing silver powder, glass frit and an organic binder is used.

A silver powder having an average particle size between 1 nm and 50 nm is used. In this embodiment, the average particle size of the silver powder is approximately 10 nm.

A glass frit having a softening point equal to or lower than that of the glass frit in the glass paste is used. For example, a $Bi_2O_3$ type glass frit having a softening point of approximately 420° C. is used.

An organic binder having a cellulose material or an acrylic material as the resin component and BCA (butyl carbitol acetate) or α-terpinenol as the solvent is used. The resin component is burnt off at a temperature of 350° C.-400° C.

The compositional ratio of the silver paste is set in such a manner that the content of glass frit after baking becomes between 1 wt % and 12 wt %. In this embodiment, the ratio of silver powder, glass frit and organic binder in the silver paste is set to 70 wt % for the silver powder, 5 wt % for the glass frit and 25 wt % for the organic binder.

Using this silver paste, address electrode patterns 2 are formed by means of screen printing, for example. More specifically, using an SX 300 screen plate having an emulsion thickness of 10 μm, patterns are printed directly onto the rear surface glass substrate 31 in such a manner that the width of the electrodes is approximately 130 μm.

Then, the solvent in the organic binder is removed by drying at a temperature of approximately 150° C.

Next, the rear surface glass substrate 31 formed with the address electrode patterns 32 in this manner is inspected using an image inspection device.

Upon actually inspecting samples by means of an image inspection device, the present inventors found no faults at all.

Then, disconnections and shorting to adjacent electrodes are checked by passing a current through the address electrode patterns 32, using an electrical inspection device.

As a result of inspecting the samples using an electrical inspection device of this kind, the inventors confirmed a line resistance value of approximately 300 kΩ, and identified no disconnection and no shorting to adjacent electrodes in the address electrode pattern 32.

After inspection of the address electrode patterns 32 by means of image recognition and electrical testing, the substrate was dried again at a temperature of approximately 200° C. By this means, the address electrode patterns 32 become resistant to being cut away in the subsequent sandblasting process.

Then, as shown in FIG. 13B, a partition paste layer 33 is formed uniformly by means of a partition-forming glass paste, so as to cover the address electrode patterns 32. The glass paste is coated (applied) by means of a reverse coating method wherein a roller rubs against the rear surface glass substrate 31 and transfers paste onto same, or a slit coating method wherein paste is coated onto the substrate by dripping it through slits, or other methods. In the reverse coating method, there is a risk of causing damage to the dried electrodes. Therefore, in this embodiment, a slit coating method is adopted. In this way, a partition paste layer 33 having a film thickness of approximately 150 μm (when dry) is formed.

Next, as shown in FIG. 13C, a DFR (dry film resist) layer 34 is formed by patterning onto the partition paste layer 33, and as shown in FIG. 13D, the open sections next to the DFR layer 34 are removed by performing sandblasting. Then, partition patterns 35 are formed by removing the DFR layer 34, as shown in FIG. 13E.

Subsequently, the address electrode patterns 32 and the partition patterns 35 are baked at a temperature between a value 20° C. below the softening point of the glass frit in the glass paste and a value 10° C. above this softening point. In this embodiment, simultaneous baking is carried out at baking temperature of approximately 570° C.

Consequently, the resin components in the address electrode patterns 32 and the partitions patterns 35 are burnt away, and the glass frit component is softened and fixed to the rear surface glass substrate 31. Accordingly, the address electrodes 36 and partitions 37 are formed on the rear surface glass substrate 31.

The ends of the partitions 37 are formed in such a manner that they make contact with the address electrodes 36 in the vicinity of the terminal section, as illustrated in FIG. 14.

The inventors inspected the rear surface glass substrate 31 formed with the address electrodes 36 and partitions 37, in the region where the partitions 37 and the address electrodes 36 contact each other as illustrated in FIG. 14, and they did not observe any disconnection or rising of the electrodes, nor any occurrence of foaming, discoloration, or the like, in the partitions 37.

Then, fluorescent layers are formed between the partitions 37, 37. The fluorescent layers are formed separately as a red fluorescent layer, a green fluorescent layer, and a blue fluorescent layer, which converts the ultraviolet light generated by discharge of the discharge gas into visible light. Next, a sealing frit, or the like, is coated onto the outer perimeter of the rear surface glass substrate 31 and this frit is baked, thereby completing the rear surface substrate.

The front surface substrate, on the other hand, is manufactured by a conventional method. In other words, transparent electrodes are formed in a parallel fashion in the horizontal direction, on the inner surface of the front surface glass substrate.

Bus electrodes (trace electrodes) for reducing the resistance value are then formed on the lower surface of the transparent electrodes, in the horizontal direction H. In this way, scanning electrodes and sustaining electrodes (common electrodes) are formed by means of the transparent electrodes and bus electrodes.

Then, a transparent dielectric layer for covering the scanning electrodes and sustaining electrodes is formed. Next, a protective film for protecting the transparent dielectric layer from discharges is formed. In this way, the front surface substrate is completed.

The front surface substrate and the rear surface substrate are then placed in opposing positions, separated from each other by a gap, and they are bonded together in such a manner that the extending direction of the electrode pairs (row direction) is orthogonal to the extending direction of the address electrodes (column direction), and in such a manner that a discharge space is formed between the two substrates. The perimeter section of the substrates is sealed hermetically by means of a sealing material made of frit glass, for example. More specifically, frit glass is coated on the perimeter section of the rear surface substrate, then the front surface substrate and the rear surface substrate are baked in the bonded state, the frit glass is melted, and the front surface substrate and the rear surface substrate become joined together in the form of a panel.

Next, the front surface substrate and the rear surface substrate forming a panel are introduced into a heating oven, an air pipe is connected to the discharge space formed between the front surface substrate and the rear surface substrate, and the substrates are heated in vacuum conditions, while expelling air from the discharge space.

A discharge gas is then introduced into the discharge space, thereby filling the discharge space, and the air pipe is then sealed by overheating, thus closing off the open end of the pipe. In this way, discharge gas is filled into the discharge space.

Thus, the plasma display panel is completed.

The inventors carried out a further electrical inspection of the address electrodes in the plasma display panel, and they discovered no disconnections at all. The display quality was also equivalent to that obtained by means of a conventional method.

In this embodiment, therefore, it is possible to reduce the time required for baking, by using simultaneous baking.

Also, since suitable values are chosen for the content ratio of glass frit in the silver paste and the average particle size of the silver powder used in the silver paste, the address electrode pattern 32 is able to display conductivity when it is dry. Therefore, electrical inspection of the address electrodes can be carried out, for example, before forming the partition paste layer 33. If any faults, such as disconnected electrodes, are revealed by this inspection, then these faults can be repaired. Consequently, it is possible to prevent a decline in production yield.

Since a glass frit in the silver paste has a softening point equal to or below that of the glass frit in the glass paste, any gas generated during the baking process due to burning off of the organic binder contained in the address electrode pattern 32, in particular, is prevented from becoming sealed inside the partition paste layer 33 covering the address electrode patterns 32, in the vicinity of the terminal sections, and remaining trapped inside the partition paste layer 33 in the form of gas bubbles. Therefore, the possibility of voltage resistance faults in the partitions (i.e., dielectric layer) 37, when the display panel is operated to display an image, can be suppressed.

By setting a suitable value for the content ratio of glass frit in the silver paste, it is possible to prevent discoloration of the dielectric layer, regardless of the type of glass frit contained in the silver paste, for example, and hence good display quality can be maintained.

Fourth Embodiment

Figure 15:
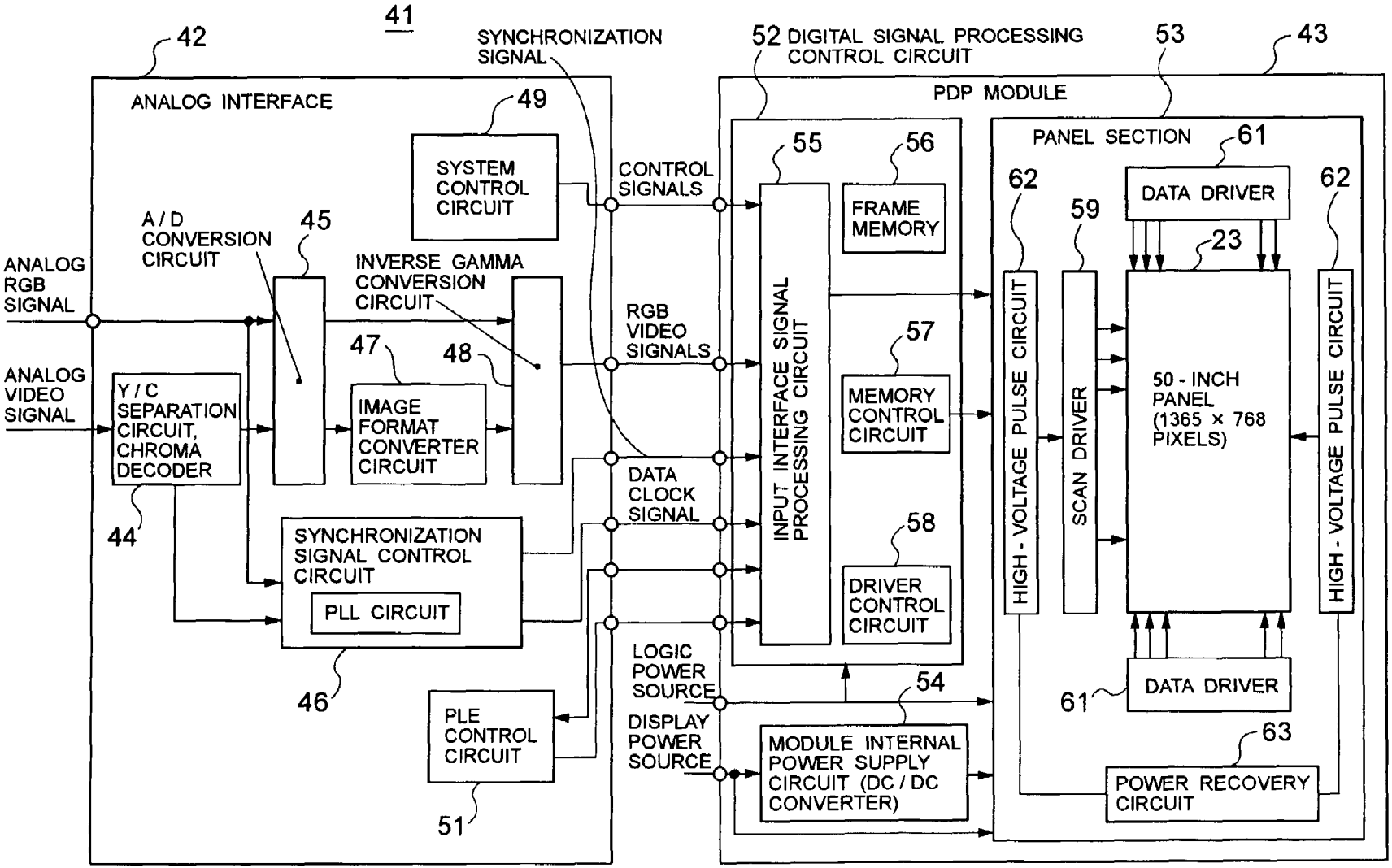
FIG. 15 is a block diagram of a plasma display apparatus manufactured by a manufacturing method according to the fourth embodiment of the invention.
Figure 16:
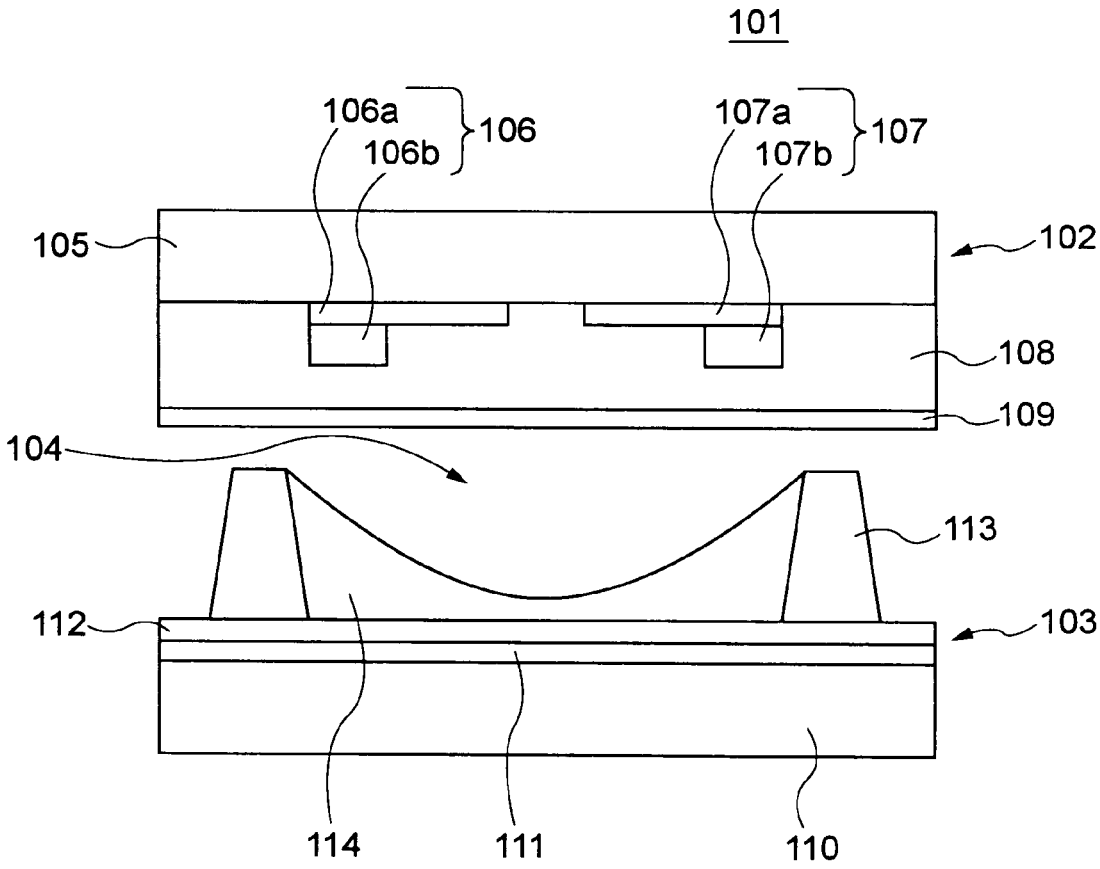
FIG. 16 illustrates a cross-sectional view of a conventional plasma display panel.
Figure 17:
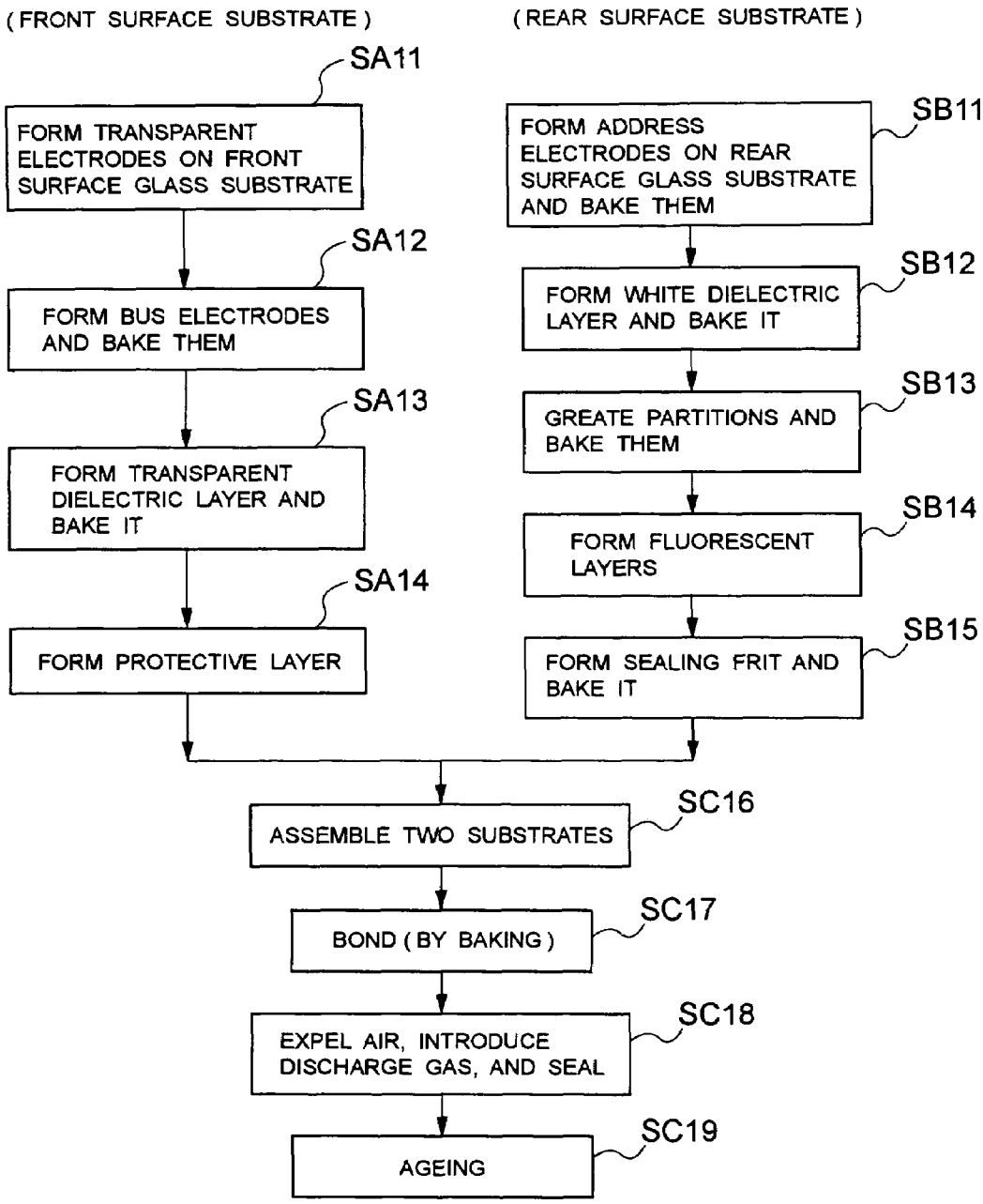
FIG. 17 illustrates a flowchart of a conventional method of manufacturing a plasma display panel.
Figure 18:
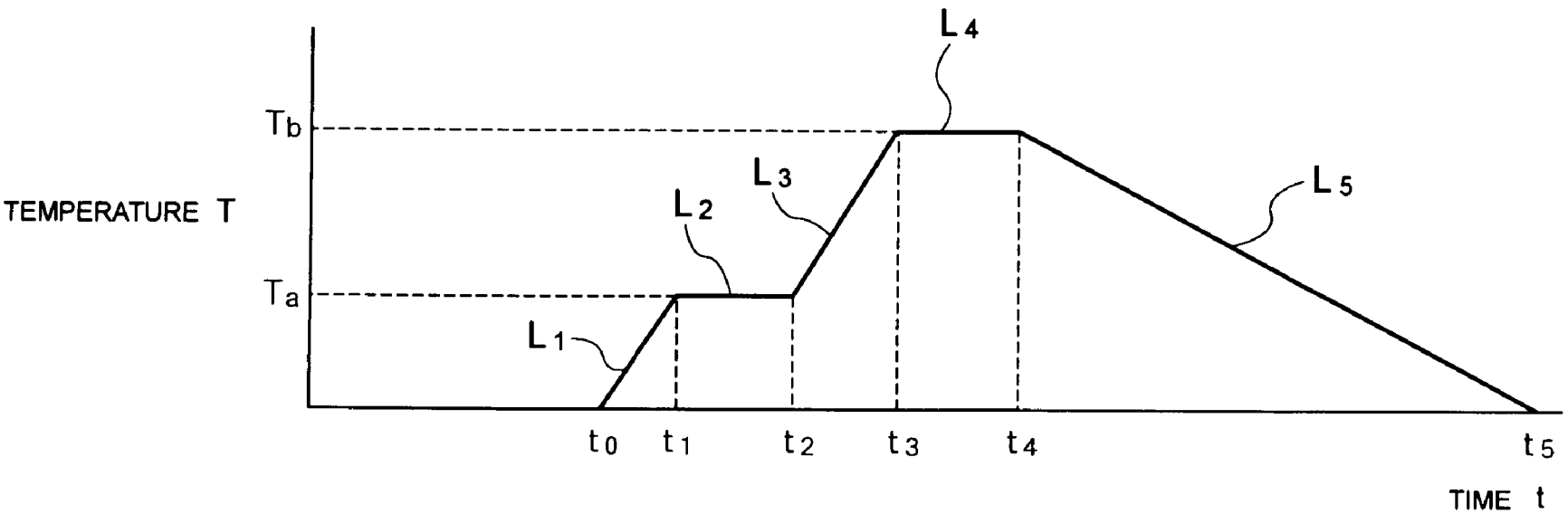
FIG. 18 shows a temperature profile in a baking process in a conventional technology.

FIG. 15 is a block diagram showing a plasma display apparatus manufactured by means of the method of manufacturing a plasma display apparatus according to the fourth embodiment of the invention.

As shown in FIG. 15, the plasma display apparatus 41 according to this embodiment is designed to have a modular structure, and more specifically, it is constituted by an analog interface (hereinafter, IF) 42 and a PDP module 43.

As shown in this diagram, the analog IF 42 includes a Y/C separation circuit 44 having a chroma decoder, an A/D conversion circuit 45, a synchronization signal control circuit 46 having a PLL circuit, an image format conversion circuit 47, a reverse γ (gamma) converting circuit 48, a system control circuit 49 and a PLE control circuit 51.

The analog IF 42 converts a received analog video signal into a digital video signal, and then supplies this digital video signal to the PDP module 43. For example, an analog video signal from a television tuner is divided into an RGB luminosity signal for each respective color by the Y/C separation circuit 44, and this signal is then converted into a digital video signal by the A/D conversion circuit 45.

If the pixel (image) composition of the PDP module 43 is different from the pixel (image) composition of the video signal, then the signal is converted to the required image format by the image format conversion circuit 47. The characteristics of the display luminosity are linearly proportional to the input signal supplied to the PDP, but generally, the video signal is previously corrected (subjected to gamma conversion) in accordance with CRT characteristics.

Therefore, after A/D conversion of the video signal in the A/D conversion circuit 45, the video signal is subjected to a reverse gamma conversion in the reverse gamma conversion circuit 48, thereby generating a digital video signal restored so as to have linear characteristics. This digital video signal is supplied to the PDP module 43 as an RGB video signal.

Since an analog video signal does not contain sampling clock or data clock signals for A/D conversion, the PLL circuit built into the synchronization signal control circuit 46 generates a sampling clock and data clock signal, on the basis of the horizontal synchronization signal that is supplied simultaneously with the analog video signal. These clock signals are transferred to the PDP module 43.

The PLE control circuit 51 in the analog IF 42 controls the luminosity. More specifically, if the average luminosity level is equal to or lower than a prescribed value, then the PLE control circuit 51 increases the display luminosity, and if the average luminosity level exceeds a prescribed value, then the PLE control circuit 51 decreases the display luminosity.

The system controller circuit 49 supplies respective control signals to the PDP module 43. The PDP module 43 includes a digital signal processing and control circuit 52, a panel section 53, and an internal power circuit 54 having a built-in D/D converter.

The digital signal processing and control circuit 52 includes an input IF signal processing circuit 55, a frame memory 56, a memory control circuit 57 and a driver control circuit 58.

For example, the average luminosity level of the video signal introduced to the input IF signal processing circuit 55 is calculated by means of an input signal average luminosity level calculating circuit (not illustrated) provided in the input IF signal processing circuit 55, and the calculated level is output as 5-bit data, for example. The PLE control circuit 51 sets PLE control data in accordance with the average luminosity level, and supplies this control data to a luminosity level control circuit (not illustrated) provided in the input IF signal processing circuit 55.

The panel section 53 includes a PDP 23, a scan driver 59 for driving the scanning electrodes, a data driver 61 for driving the data electrodes, a high-voltage pulse circuit 62 for supplying a pulse voltage to the PDP 23 and scan driver 59, and a power recovery circuit 63 for recovering surplus power from the high-voltage pulse circuit 62.

The PDP 23 has pixels disposed in a 1365×768 array, for example. In the PDP 23, by means of the scan driver 59 controlling the scanning electrodes and the data driver 61 controlling the data electrodes, desired pixels in the pixel array are caused to light up or not to light up, thereby providing a desired display.

A logic power source is supplied to the digital signal processing and control circuit 52 and the panel section 53. The internal power circuit 54 is fed with a DC power from the display power supply, converts this DC power to a prescribed voltage, and then supplies it to the panel section 53.

Next, a method of manufacturing a plasma display apparatus 41 will be described in general terms, with reference to FIG. 15.

Firstly, a panel section 53 is formed by disposing a PDP 23, scan driver 59, data driver 61, high-voltage pulse circuit 62 and power recovery circuit 63 on the same substrate. A digital signal processing and control circuit 52 is formed separately from the panel section 53.

The panel section 53 and the digital signal processing and control circuit 52 formed in this manner are assembled into a single module, thereby creating a PDP module 43. In the meantime, an analog IF 42 is formed separately from the PDP module 43.

When the analog IF 42 and PDP module 43 are formed separately, the two modules are connected electrically, thereby completing the plasma display apparatus 41.

By forming the plasma display apparatus 41 in a modular fashion as described above, it is possible to manufacture a PDP module 43 independently of the other constituent components which make up the plasma display apparatus 41. Accordingly, if a problem is found in the plasma display apparatus 41, for example, repairs can be performed more simply and more rapidly, by changing the PDP module 43.

Embodiments of the present invention are described in detail above with reference to the drawings, but the concrete composition of the invention is not limited to these embodiments, and any modifications of the design within a scope that does not depart from essence of the invention are also encompassed by the present invention.

For example, in the embodiments described above, the temperature at which the sintering shrinkage phase changes to a soft fluid phase in differential thermal analysis is taken to be the softening point, but it is also possible to use the softening point as defined by the viscosity.

More specifically, the temperature at which the viscosity $\eta$ of the manufactured glass becomes $4.5\times10^7$ dPas ($=10^{7.65}$ ps) is taken as the softening point. This softening point is the temperature at which the speed of extension of the glass under its own weight reaches 1 mm/min, when a glass thread of diameter 0.55-0.75 mm (±0.02 mm) and length 229 mm is heated at a temperature increase rate of 10° C./min.

In this case, the baking temperature for simultaneous baking is set to a temperature between the softening point of the glass frit and 30° C. above the softening point.

In the foregoing description, either the front surface substrate or the rear surface substrate is manufactured by means of conventional technology, i.e., the electrode layer and the dielectric layer are baked separately. However, it is possible to adopt a method wherein electrode patterns and dielectric layer patterns are baked simultaneously, for both of the substrates, by setting appropriate values for the manufacturing conditions, such as the content of glass frit in the silver paste, the relationship between the softening points of the frit glass in the silver paste and the glass paste, and the average particle size of the silver powder.

In the second embodiment, it is also possible to achieve electrical conductivity in the silver bus electrode layer pattern after drying, by setting the average particle size of the silver powder to approximately 1 nm-50 nm and including glass frit to a content ratio of 1-12 wt %.

In the second embodiment, it is also possible to include glass frit in the silver paste for forming the silver bus electrodes, the ratio of the glass frit in this silver paste being set in such a manner that it has a content between 1 wt % and 12 wt % after baking, and the softening point of the glass frit in both the silver paste and the conductive paste being set to a temperature equal to or lower than the softening point of the glass frit in the glass paste.

The invention may also be applied to cases where copper powder, aluminum powder, or the like, is used as the metallic powder, instead of silver powder or gold powder.

This application is based on Japanese Patent Application No. 2003-415813 filed on Dec. 12, 2003 and Japanese Patent Application No. 2004-285332 filed on Sep. 29, 2004, and the entire disclosures of these two applications are incorporated herein by reference.

What is claimed is:

1. A method of manufacturing a plasma display panel comprising:

providing a pair of substrates in opposing positions;

a first step of forming a metal paste layer, in which metal powder and a first glass frit are combined at a prescribed ratio, onto at least one substrate of the pair of substrates;

a second step of forming a glass paste layer containing a second glass frit onto said metal paste layer; and a third step of forming an electrode layer and a dielectric layer by simultaneously baking said metal paste and said glass paste;

wherein said prescribed ratio in said first step is set in such a manner that a content ratio of said first glass frit in said electrode layer is between 1 wt % and 12 wt %, and said first glass frit has a softening point equal to or lower than a softening point of said second glass frit, and wherein an average particle size of said metal powder used in said first step is between 1 nm and 50 nm.

2. The method of manufacturing a plasma display panel according to claim 1 wherein said metal powder comprises at least one of a silver powder or a gold powder.

3. The method of manufacturing a plasma display panel according to claim 1 further comprising an inspection step for inspecting electrical characteristics of said metal paste layer before said glass paste for forming said dielectric layer is formed.

4. The method of manufacturing a plasma display panel according to claim 1, wherein a baking temperature for forming said electrode layer and said dielectric layer is set to a value between a softening point, as defined on the basis of a viscosity of the second glass frit used in order to form said dielectric layer, and a temperature 30° C. above said softening point.

5. The method of manufacturing a plasma display panel according to claim 1, wherein, when taking a softening point of the second glass frit for forming said dielectric layer to be a temperature at which a sample of the second glass frit changes from a sintering shrinkage phase to a soft fluid phase with increase in temperature in a differential thermal analysis, the baking temperature for forming said electrode layer and said dielectric layer is set to a value between a first temperature 20° C. below said softening point and a second temperature 10° C. above said softening point.

6. A method of manufacturing a plasma display apparatus, comprising:

preparing a plasma display panel in accordance with a method of claim 1;

assembling said plasma display panel together with a circuit for driving said plasma display panel, as one module; and electrically connecting, to said module, an interface for converting a format of an image signal and sending said signal to said module.

* * * * *